US010461487B2

(12) United States Patent
Okuda et al.

(10) Patent No.: US 10,461,487 B2
(45) Date of Patent: Oct. 29, 2019

(54) TERMINAL CRIMPING APPARATUS

(71) Applicant: Yazaki Corporation, Tokyo (JP)

(72) Inventors: Yuta Okuda, Shizuoka (JP); Keiichiroh Kurashige, Shizuoka (JP); Naoki Ito, Shizuoka (JP); Koichi Ikebe, Shizuoka (JP); Hidehiko Iwasawa, Shizuoka (JP); Junya Shinohara, Shizuoka (JP); Syunsuke Yaoita, Shizuoka (JP); Kei Sato, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 247 days.

(21) Appl. No.: 15/722,466

(22) Filed: Oct. 2, 2017

(65) Prior Publication Data

US 2018/0109057 A1 Apr. 19, 2018

(30) Foreign Application Priority Data

Oct. 13, 2016 (JP) ..... 2016-201873

(51) Int. Cl.

*H01R 43/048* (2006.01)
*H01R 43/055* (2006.01)
*H01R 4/18* (2006.01)

(52) U.S. Cl.

CPC ..... *H01R 43/048* (2013.01); *H01R 43/0482* (2013.01); *H01R 4/185* (2013.01);
(Continued)

(58) Field of Classification Search

CPC .. H01R 4/185; H01R 43/048; H01R 43/0482; H01R 43/055; H01R 43/058; Y10T 29/49185; Y10T 29/5149; Y10T 29/53235
See application file for complete search history.

(56) References Cited

U.S. PATENT DOCUMENTS 4,856,183 A 8/1989 Belaidouni et al.
5,636,438 A * 6/1997 Takagishi ..... H01R 43/04 29/753

(Continued)

FOREIGN PATENT DOCUMENTS

CN 103765681 A 4/2014
CN 105846275 A 8/2016

(Continued)

OTHER PUBLICATIONS

Chinese Office Action for the related Chinese Patent Application No. 2017109003742 dated Dec. 20, 2018.

*Primary Examiner* — Peter Dungba Vo
*Assistant Examiner* — Joshua D Anderson
(74) *Attorney, Agent, or Firm* — Kenealy Vaidya LLP

(57) ABSTRACT

A terminal crimping apparatus includes a terminal supply device configured to supply a terminal chain member including a plurality of crimping terminals, a first mold including a first edge portion provided at one end of a supporting surface supporting the crimping terminals, a second mold configured to crimp the crimping terminal onto a wire by sandwiching the crimping terminal between the second mold and the supporting surface, and a terminal cutting member including a second edge portion. The terminal cutting member cuts a boundary with the crimping terminal in a link portion using the second edge portion.

8 Claims, 25 Drawing Sheets

(52) U.S. Cl.
CPC ..... *H01R 43/055* (2013.01); *Y10T 29/49181* (2015.01); *Y10T 29/49185* (2015.01); *Y10T 29/5149* (2015.01); *Y10T 29/53235* (2015.01)

(56) References Cited

U.S. PATENT DOCUMENTS

| | | | | |
|---|---|---|---|---|
| 2001/0045008 | A1* | 11/2001 | Fukase ..... | H01R 43/048 29/761 |
| 2014/0206245 | A1 | 7/2014 | Sato | |
| 2015/0364838 | A1* | 12/2015 | Tonoike ..... | H01R 4/187 439/879 |

FOREIGN PATENT DOCUMENTS

| | | | |
|---|---|---|---|
| JP | 2008-234925 | A | 10/2008 |
| JP | 2016-143502 | A | 8/2016 |

* cited by examiner

TERMINAL CRIMPING APPARATUS

CROSS-REFERENCE TO RELATED APPLICATION(S)

The present application claims priority to and incorporates by reference the entire contents of Japanese Patent Application No. 2016-201873 filed in Japan on Oct. 13, 2016.

BACKGROUND OF THE INVENTION

1. Field of the Invention

The present invention relates to a terminal crimping apparatus.

2. Description of the Related Art

Conventionally, there has been a terminal crimping apparatus that crimps crimping terminals of a terminal chain member to a wire, and cuts off the crimping terminals from the terminal chain member. For example, JP 2008-234925 A discloses a technique of a manufacturing method of a terminal-provided wire. More specifically, the manufacturing method supplies, one by one, crimping terminals joined to a band-like carrier in a state of protruding in a width direction, and arrayed in parallel in a length direction of the carrier, onto a terminal reception member, detaches the crimping terminals from the carrier by shearing a joint portion joining the carrier and the crimping terminals, using a shearing unit, and crimps the crimping terminals to an end portion of a wire by swaging barrel portions of the crimping terminals supplied onto the terminal reception member, using a terminal crimping member, in cooperation with the terminal reception member.

According to the manufacturing method of a terminal-provided wire that is disclosed in Japanese Patent Application Laid-open No. 2008-234925, it is assumed that an operation of cutting off the joint portion of the carrier and the crimping terminals, into a desired length, and an operation of crimping the crimping terminals to the end portion of the wire can be performed accurately and stably.

Here, when a link portion of a terminal chain member is cut, and a crimping terminal is cut off from the terminal chain member, it is desirable to minimize a length of a cutoff remaining in the crimping terminal. As a method for shortening the cutoff, it is effective to shorten a first mold supporting the crimping terminal. If the first mold is shortened, and a portion larger as much as possible of the link portion is caused to protrude from the first mold toward a terminal cutting member side, the cutoff can be shortened.

Here, if the first mold is shortened, a second mold that crimps the crimping terminal in cooperation with the first mold comes close to the terminal cutting member side together with the first mold. Nevertheless, if the second mold comes close to the terminal cutting member side, the second mold may interfere with the terminal cutting member.

SUMMARY OF THE INVENTION

The object of the present invention is to provide a terminal crimping apparatus that can shorten a cutoff while suppressing interference between members.

A terminal crimping apparatus according to one aspect of the present invention includes a terminal supply device configured to supply a terminal chain member including a plurality of crimping terminals arranged in parallel, a joint piece extending in an arrangement direction of the plurality of crimping terminals, and link portions linking one ends of the crimping terminals and the joint piece; a first mold including a supporting surface supporting the crimping terminals supplied by the terminal supply device, and a first edge portion provided at one end of the supporting surface; a second mold disposed to face the supporting surface, and configured to crimp the crimping terminal onto a wire by sandwiching the crimping terminal and the wire between the second mold and the supporting surface while relatively moving with respect to the supporting surface; and a terminal cutting member disposed adjacently to the first mold, and including a second edge portion corresponding to the first edge portion, wherein the terminal cutting member cuts a boundary with the crimping terminal in the link portion using the second edge portion, in cooperation with the first edge portion, while relatively moving with respect to the first mold in a same direction as a movement of the second mold, the second mold includes a main body, and a pair of wall portions protruding from the main body toward the first mold side, and facing each other in the arrangement direction of the crimping terminals, and coming into contact with the crimping terminal to bend the crimping terminal, the pair of wall portions include proximal end portions being portions provided on the main body side, and hem portions being portions provided closer to a distal end side than the proximal end portions, and the main body and the proximal end portions protrude toward the terminal cutting member side compared to the first edge portion, and the hem portions are positioned closer to the first mold side than the first edge portion.

According to another aspect of the present invention, in the terminal crimping apparatus, it is preferable that the hem portions are provided in a range set according to a movement distance by which the second mold relatively moves with respect to the terminal cutting member when the crimping terminal is crimped.

According to still another aspect of the present invention, in the terminal crimping apparatus, it is preferable that the terminal cutting member includes a protruding portion to be inserted into a hole portion included in the joint piece, to position the crimping terminal.

According to still another aspect of the present invention, in the terminal crimping apparatus, it is preferable that a surface on the first mold side of the terminal cutting member includes a groove portion being a pathway of the joint piece, and a guide portion configured to guide the joint piece to adjust a position of the crimping terminal is provided in an opening portion on the first mold side of the groove portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A terminal crimping apparatus according to an embodiment of the present invention will be described in detail below with reference to the drawings. In addition, the present invention is not limited by the embodiment. In addition, components in the following embodiment include the ones easily-conceived by those skilled in the art, or the ones that are substantially identical.

Embodiment

Figure 12:
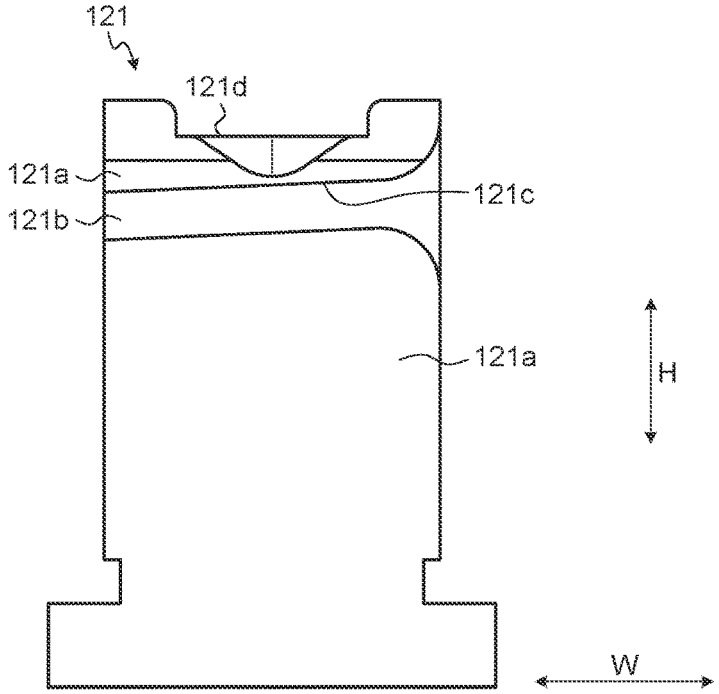
FIG. 12 is a rear view illustrating the terminal cutting member according to an embodiment.
Figure 13:
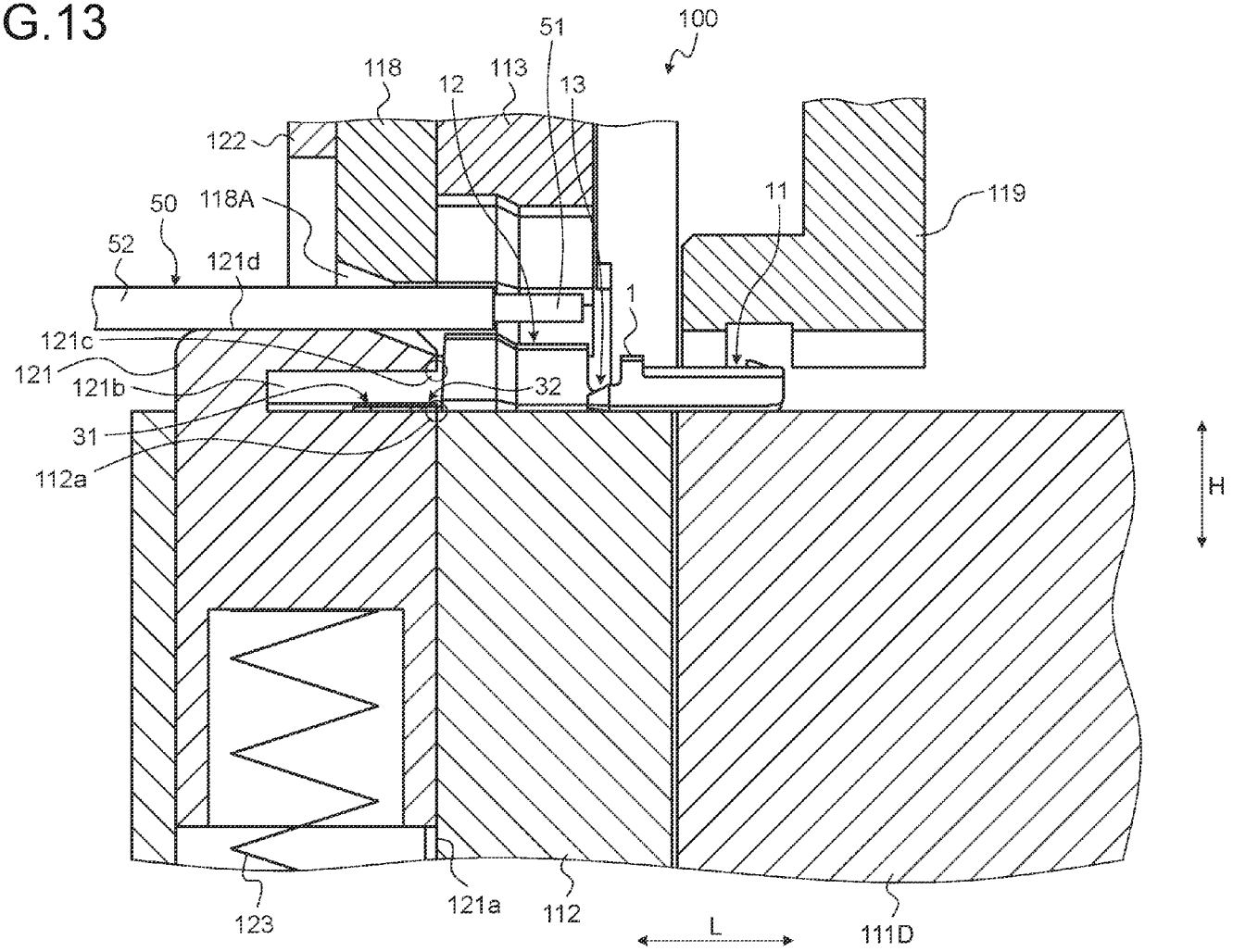
FIG. 13 is a cross-sectional view illustrating a state in which a wire and the crimping terminal are set in the terminal crimping apparatus according to an embodiment.
Figure 15:
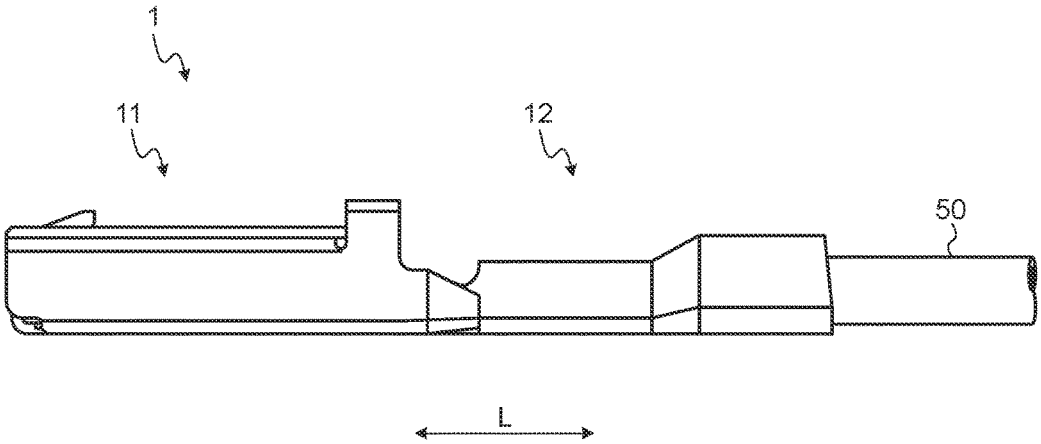
FIG. 15 is a side view illustrating the crimping terminal according to the present embodiment that has been cut off from the terminal chain member.
Figure 16:
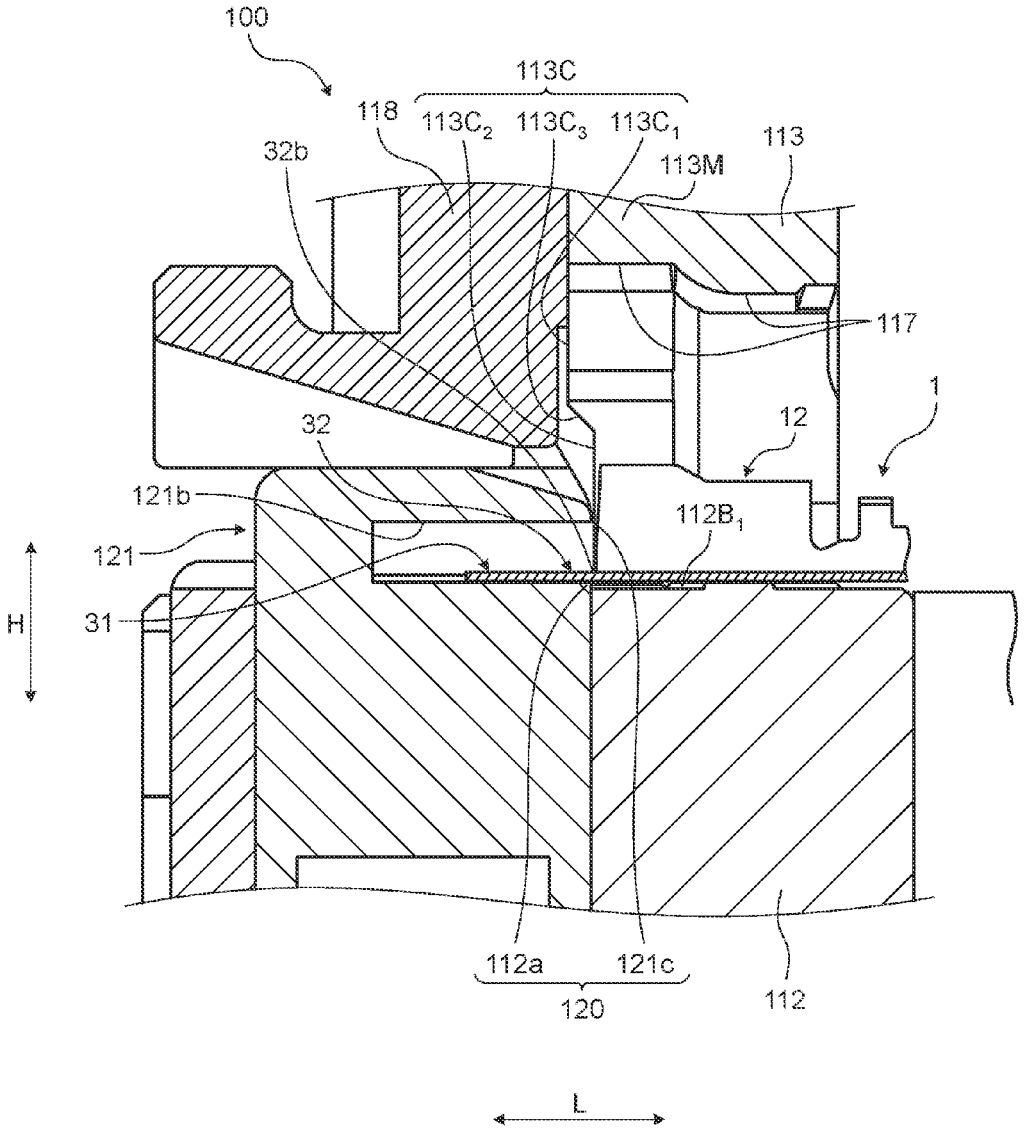
FIG. 16 is a cross-sectional view illustrating positional relationship of the terminal crimping apparatus according to the present embodiment.

An embodiment will be described with reference to FIGS. 1 to 19. The present embodiment relates to a terminal crimping apparatus. In addition, FIG. 13 illustrates a XIII-XIII cross section in FIG. 9. In addition, FIG. 16 is a detailed cross-sectional view of the same cross-sectional position as that of FIG. 13.

First of all, a crimping terminal 1 according to the present embodiment will be described. The crimping terminal 1 illustrated in FIG. 1 and the like is a terminal to be crimped onto a wire 50. The crimping terminal 1 is electrically-connected to another terminal (not illustrated) in a state of being integrated with the wire 50. A covering 52 at an end portion of the crimping target wire 50 is removed, and a core wire 51 is exposed by a predetermined length. The core wire 51 may be an aggregate of a plurality of wires, or may be a single wire such as a coaxial cable. By being crimped to the end portion of the wire 50, the crimping terminal 1 is electrically-connected to the exposed core wire 51.

The crimping terminal 1 includes a terminal fitting 10 and a water stop member 20. The terminal fitting 10 is a main portion of the crimping terminal 1. The terminal fitting 10 is formed of a conductive metal plate serving as a base material (e.g., copper plate, copper alloy plate). The terminal fitting 10 is formed into a predetermined shape that enables connection to the other terminal and the wire 50, through punching processing, bending processing, and the like that are performed on the base material. The terminal fitting 10 includes a terminal connection portion 11 and a wire connection portion 12. The terminal connection portion 11 is a portion to be electrically-connected to the other terminal. The wire connection portion 12 is a portion to be crimped onto the wire 50, and is electrically-connected to the core wire 51. A joint portion 13 is provided between the terminal connection portion 11 and the wire connection portion 12. In other words, the terminal connection portion 11 and the wire connection portion 12 are joined via the joint portion 13. The joint portion 13 includes side walls 13*a* and 13*a* that link side walls 11*a* and 11*a* of the terminal connection portion 11 and barrel piece portions 15 and 16 being side walls of the wire connection portion 12. One side wall 13*a* links one side wall 11*a* and a first barrel piece portion 15, and the other side wall 13*a* links the other side wall 11*a* and a second barrel piece portion 16. A height of the side walls 13*a* is lower than heights of the barrel piece portions 15 and 16, and the side walls 11*a*. More specifically, the height of the side walls 13*a* becomes lower from the terminal connection portion 11 toward the wire connection portion 12.

The terminal fitting 10 may be a male terminal or a female terminal. When the terminal fitting 10 is a male terminal, the terminal connection portion 11 is molded into a male die, and when the terminal fitting 10 is a female terminal, the terminal connection portion 11 is molded into a female die.

In the description of the crimping terminal 1, a direction in which the crimping terminal 1 is connected to the other terminal, that is, a direction in which the crimping terminal 1 is inserted into the other terminal will be referred to as a first direction L. The first direction L is a longitudinal direction of the crimping terminal 1. A parallel arrangement direction of the crimping terminals 1 will be referred to as a second direction W. As described later, the parallel arrangement direction is a direction in which the crimping terminals 1 are arranged in parallel in a terminal chain member 30, and is a width direction of the crimping terminal 1. In the crimping terminal 1, a direction perpendicular to both of the first direction L and the second direction W will be referred to as a third direction H. The third direction H is a height direction of the crimping terminal 1.

Figure 1:
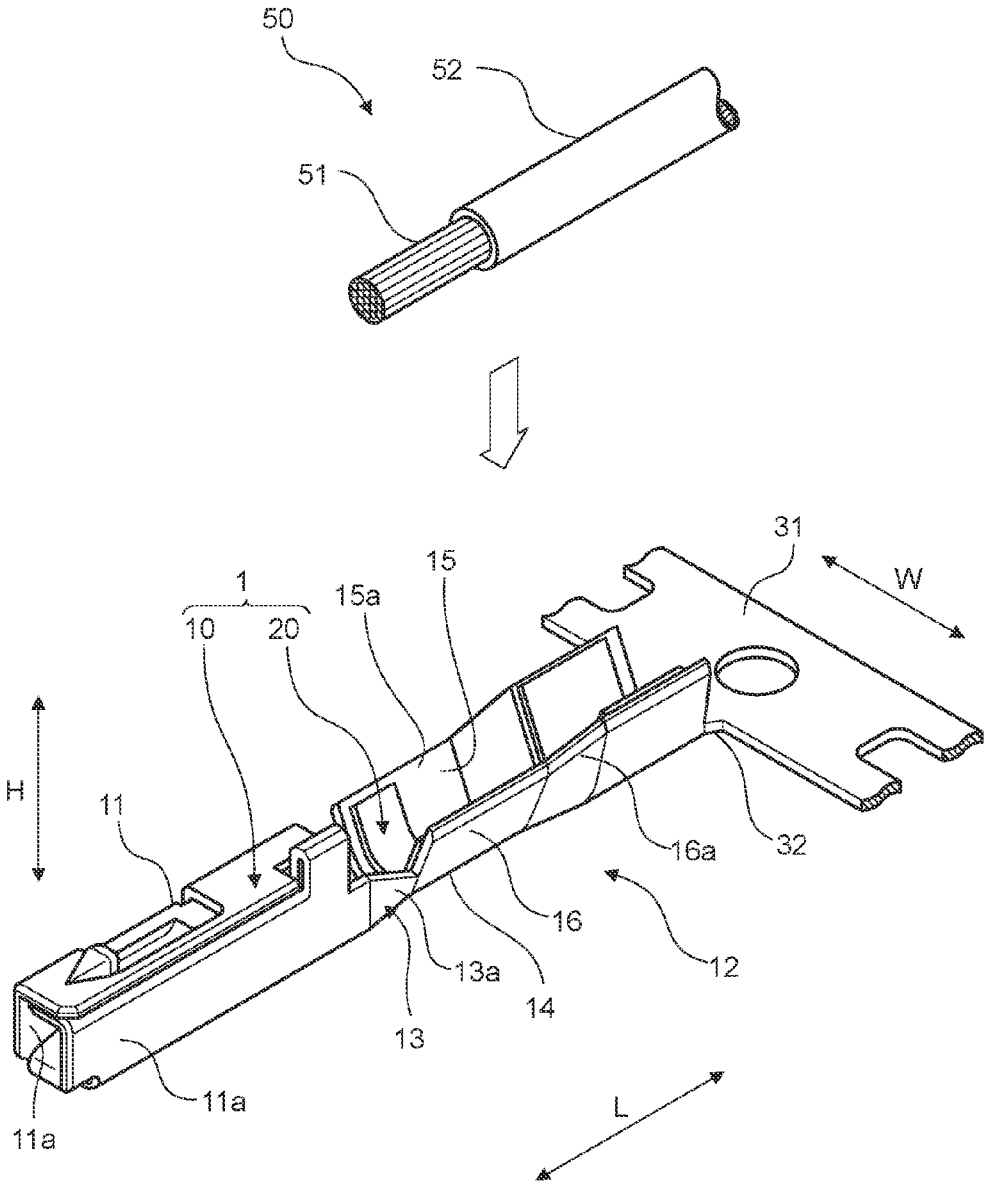
FIG. 1 is a perspective view illustrating a state before crimping of a crimping terminal according to an embodiment.
Figure 2:
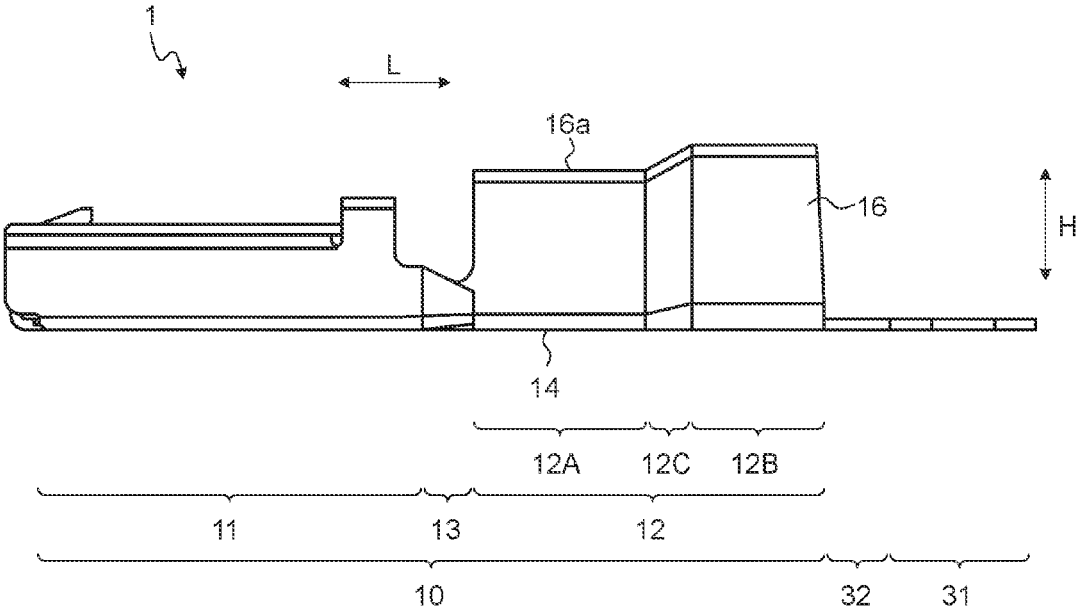
FIG. 2 is a side view illustrating a state before crimping of the crimping terminal according to an embodiment.
Figure 3:
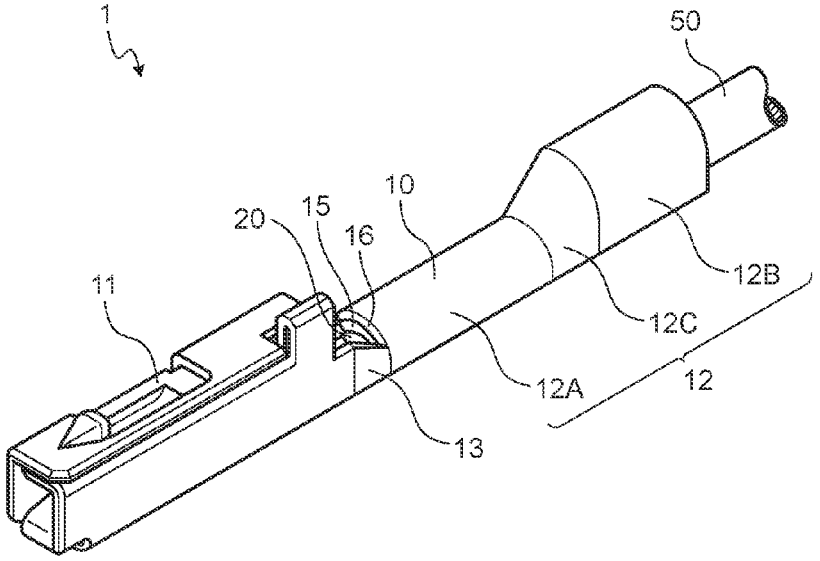
FIG. 3 is a perspective view illustrating the crimping terminal according to an embodiment that is obtainable after crimping.
Figure 4:
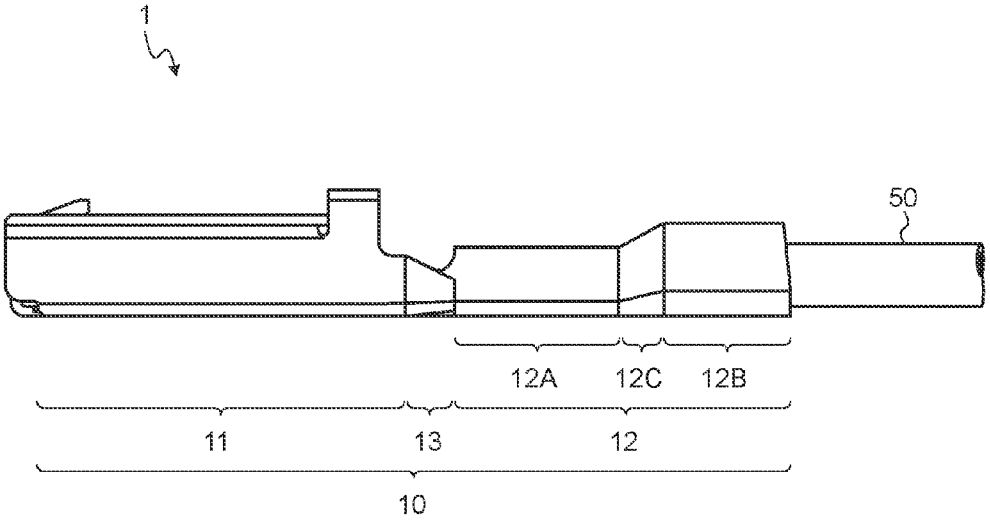
FIG. 4 is a side view illustrating the crimping terminal according to an embodiment that is obtainable after crimping.

In a molding process, the crimping terminal 1 is molded into a flat plate shape, and from this state, in a terminal connection portion shaping process, the terminal connection portion 11 is formed into a tubular shape as illustrated in FIG. 1. In the terminal connection portion shaping process, the bending processing and the like are performed on the terminal connection portion 11. The terminal connection portion 11 of the present embodiment is formed into a tubular shape having an oblong cross-sectional shape. In a wire connection portion shaping process, the wire connection portion 12 is molded so as to have a U-shaped cross-sectional shape. In the wire connection portion shaping process, the bending processing and the like are performed on the wire connection portion 12. In addition, the water stop member 20 is attached to the wire connection portion 12 in an attaching process. The attaching process may be executed before the wire connection portion shaping process, or may be executed after the wire connection portion shaping process.

Figure 6:
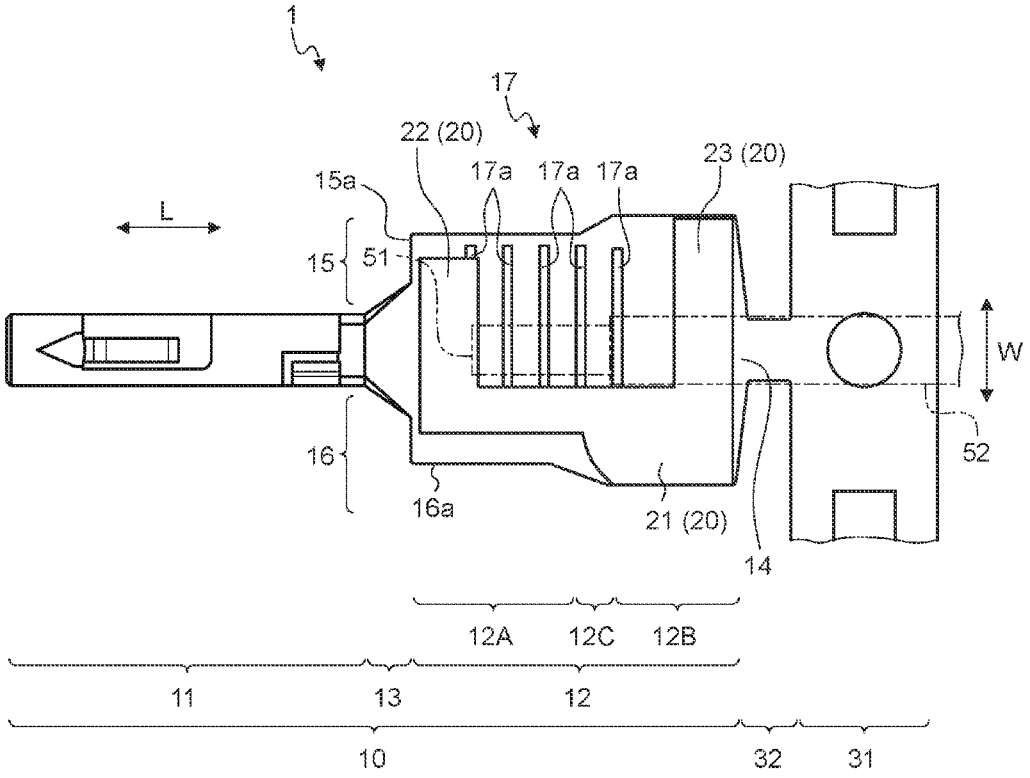
FIG. 6 is a plan view illustrating a state in which a water stop member is attached in the crimping terminal according to an embodiment.

As illustrated in FIGS. 1 and 6, the wire connection portion 12 includes a bottom portion 14, the first barrel piece portion 15, and the second barrel piece portion 16. The bottom portion 14 is a region serving as a bottom wall of the wire connection portion 12 formed into the U-shape. In crimping processing, the end portion of the wire 50 is placed on the bottom portion 14. The first barrel piece portion 15 and the second barrel piece portion 16 are regions serving as side walls of the wire connection portion 12 formed into the U-shape. The first barrel piece portion 15 and the second barrel piece portion 16 are connected to end portions in the second direction W of the bottom portion 14. The first barrel piece portion 15 and the second barrel piece portion 16 protrude from the end portions in the width direction of the bottom portion 14, toward directions intersecting with the width direction. In the wire connection portion 12 formed into the U-shape, when the end portion of the wire 50 is placed on the bottom portion 14, the first barrel piece portion 15 and the second barrel piece portion 16 surround the wire 50 from both sides in the second direction W.

Lengths from roots on the bottom portion 14 side to end surfaces of distal ends 15*a* and 16*a* of the first barrel piece portion 15 and the second barrel piece portion 16 may be equal to each other, or one length may be longer than the other length. In the crimping terminal 1 of the present embodiment, the length from the root to the distal end 16*a* of the second barrel piece portion 16 is longer than the length from the root to the distal end 15*a* of the first barrel piece portion 15. For example, the first barrel piece portion 15 and the second barrel piece portion 16 are winded around the wire 50 while overlapping each other. In the present embodiment, the second barrel piece portion 16 overlaps on the outside of the first barrel piece portion 15. In addition, swaging referred to as so-called B crimping may be performed on the first barrel piece portion 15 and the second barrel piece portion 16. In the B crimping, both of the first barrel piece portion 15 and the second barrel piece portion 16 are bent toward the bottom portion 14 side, and swaged so that the distal ends 15*a* and 16*a* are pressed against the wire 50. Because the crimping terminal 1 of the present embodiment is provided with the water stop member 20 to be described later, the former swaging processing is employed.

The end portion of the wire 50 is inserted into a U-shaped inner space from a U-shaped opening portion of the wire connection portion 12, that is, from a clearance gap between the distal ends 15*a* and 16*a*. The wire connection portion 12 is formed so that the end portion of the wire 50 can be easily inserted. More specifically, in the wire connection portion 12, a distance in the second direction W between the first barrel piece portion 15 and the second barrel piece portion 16 widens from the bottom portion 14 side toward the end surfaces of the distal ends 15*a* and 16*a*.

As illustrated in FIGS. 2 to 6, in the first barrel piece portion 15 and the second barrel piece portion 16, a joint crimping portion 12C interposes between a core wire crimping portion 12A and a covering crimping portion 12B. Each of the first barrel piece portion 15 and the second barrel piece portion 16 is one piece portion in which the crimping portions 12A, 12C, and 12B are consecutively arranged in the first direction L in this order.

The core wire crimping portion 12A is a region to be crimped onto the core wire 51 at the distal end of the wire 50. The core wire crimping portion 12A is a region closest to the joint portion 13 in each of the barrel piece portions 15 and 16. The covering crimping portion 12B is a region to be crimped onto an end portion of the covering 52. The covering crimping portion 12B is a region positioned on the farthest side from the joint portion 13 side in each of the barrel piece portions 15 and 16. The joint crimping portion 12C is a region linking the core wire crimping portion 12A and the covering crimping portion 12B. The joint crimping portion 12C is crimped onto a boundary portion between the core wire 51 and the covering 52 of the wire 50. By being crimped onto the wire 50, the wire connection portion 12 integrally covers the core wire 51 and the covering 52.

Figure 5:
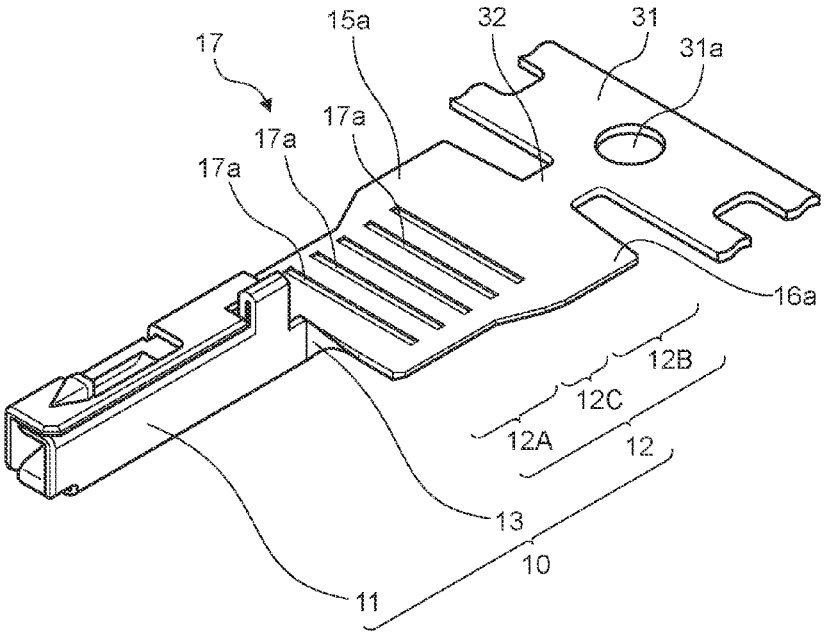
FIG. 5 is a perspective view illustrating a state before an attaching process is executed in the crimping terminal according to an embodiment.

As illustrated in FIGS. 5 and 6, a serration region 17 is provided on an inner wall surface of the wire connection portion 12, that is, on a wall surface on the side covering the wire 50. The serration region 17 is a core wire holding region for holding the core wire 51. The serration region 17 is a region on the inner wall surface of the wire connection portion 12 that includes a portion to be winded around the core wire 51. A plurality of recessed portions, a plurality of projection portions, or combinations of recessed portions and projection portions are arranged on the serration region 17. The recessed portions and the projection portions increase a contact area between the wire connection portion 12 and the core wire 51 to enhance the strength of adhesion therebetween. The serration region 17 of the present embodiment is an oblong region, and a plurality of recessed portions 17*a* are formed at positions different from each other in the first direction L.

Here, ingress of water between the core wire 51 and the wire connection portion 12 crimped onto the core wire 51 is not preferable. For example, when the metal material of the core wire 51 and the metal material of the wire connection portion 12 have different-sized ionization tendencies, corrosion may occur. As an example, when the material of the core wire 51 is aluminum, and the material of the wire connection portion 12 is copper, the core wire 51 may corrode. The crimping terminal 1 of the present embodiment is provided with the water stop member 20. The water stop member 20 suppresses ingress of water between the wire connection portion 12 and the core wire 51.

For example, the water stop member 20 is a member formed into a sheet mainly containing adhesive such as acrylic adhesive. As the water stop member 20 of the present embodiment, an adhesive sheet being formed of sheet-like nonwoven cloth saturated with adhesive, and having an adhesive effect on the both sides is used.

For example, the water stop member 20 is attached onto the inner wall surface of the flat-plate-shaped wire connection portion 12 illustrated in FIG. 5. As illustrated in FIG. 6, the water stop member 20 is formed into a predetermined shape, and includes a first water stop portion 21, a second water stop portion 22, and a third water stop portion 23. After the completion of crimping, the first water stop portion 21 stops water ingress into an overlapping portion of the first barrel piece portion 15 and the second barrel piece portion 16. More specifically, the first water stop portion 21 forms a water stop region between the barrel piece portions 15 and 16 by being sandwiched between the first barrel piece portion 15 and the second barrel piece portion 16 overlapping each other. The first water stop portion 21 of the present embodiment is disposed in the second barrel piece portion 16, and extends in the first direction L.

The second water stop portion 22 stops water ingress into a portion on the terminal connection portion 11 side from the distal end of the core wire 51. The second water stop portion 22 is disposed at an end portion on the terminal connection portion 11 side of the wire connection portion 12, and extends in the second direction W. At least part of the second water stop portion 22 is desirably provided in a region in which the core wire 51 is placed. For example, the second water stop portion 22 forms a water stop region in a clearance gap between the barrel piece portions 15 and 16 by being sandwiched between the overlapping barrel piece portions 15 and 16. The second water stop portion 22 can also block a clearance gap provided on the terminal connection portion 11 side from the distal end of the core wire 51, by overlapping each other in a crimping process The second water stop portion 22 suppresses ingress of water between the wire connection portion 12 and the core wire 51 from the terminal connection portion 11 side.

The third water stop portion 23 suppresses ingress of water from a clearance gap between the wire connection portion 12 and the covering 52. The third water stop portion 23 is disposed at an end portion on an opposite side of the terminal connection portion 11 side of the wire connection portion 12, and extends in the second direction W. The third water stop portion 23 forms a water stop region between the covering 52 and the wire connection portion 12 by being sandwiched between the covering 52 and the wire connection portion 12.

Through a press process performed on one metal plate serving as a base material, the above-described terminal fitting 10 is processed into a configuration having the flat-plate-shaped wire connection portion 12 illustrated in FIG. 5. In the subsequent attaching process, the water stop member 20 is attached to the flat-plate-shaped wire connection portion 12. After that, in the terminal fitting 10, in a bending process, the terminal connection portion 11 is formed, and the U-shaped wire connection portion 12 is formed.

Figure 7:
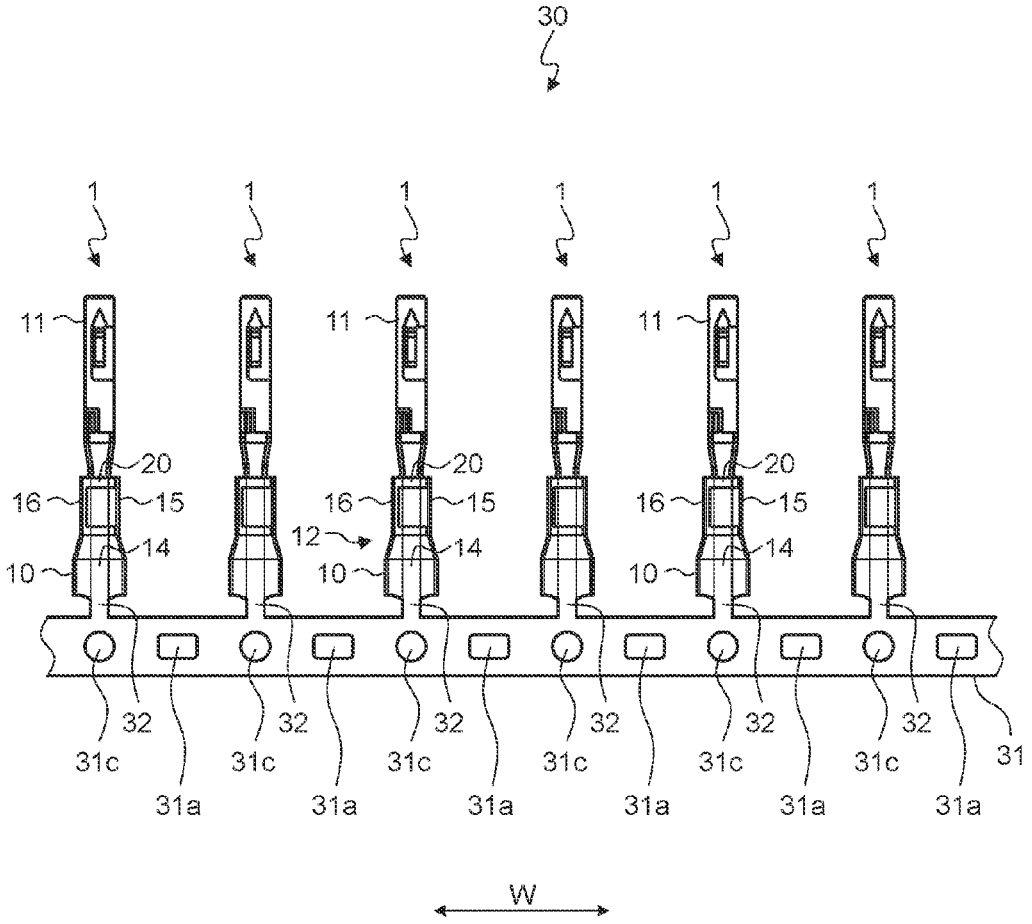
FIG. 7 is a plan view illustrating a terminal chain member according to an embodiment.

In the present embodiment, the terminal chain member 30 illustrated in FIG. 7 is formed through the press process and the bending process. The terminal chain member 30 is obtained by chaining a plurality of the crimping terminals 1, and is formed of one metal plate. The terminal chain member 30 is supplied to a terminal crimping apparatus 100. The terminal crimping apparatus 100 executes the crimping process and a terminal cutting process on the terminal chain member 30. The crimping process is a process of swaging and crimping the crimping terminal 1 of the terminal chain member 30 onto the wire 50. The terminal cutting process is a process of cutting off the crimping terminal 1 swaged to the wire 50, from the terminal chain member 30.

The terminal chain member 30 is an aggregate of the crimping terminals 1. The terminal chain member 30 includes a joint piece 31, the plurality of crimping terminals 1, and a plurality of link portions 32. The joint piece 31, the crimping terminals 1, and the link portions 32 are integrally formed of the same base material. In the terminal chain member 30, the crimping terminals 1 are oriented in the same direction, and arranged in parallel at equal intervals. In the terminal chain member 30, one end portions of the respective crimping terminals 1 are linked to each other by the joint piece 31. For example, the shape of the joint piece 31 is a thin and long oblong plate shape. The joint piece 31 extends in the second direction W. The wire connection portions 12 are connected to the joint piece 31 via the link portions 32. More specifically, the link portions 32 link the end portions on the opposite side of the terminal connection portion 11 side of the bottom portions 14 to the joint piece 31.

A plurality of terminal feed holes 31*a* are formed in the joint piece 31. The terminal feed holes 31*a* are arranged at equal intervals in a feed direction of the terminal chain member 30. The terminal feed holes 31*a* are through-holes penetrating through the joint piece 31 in a plate thickness direction. The crimping terminals 1 are positioned by the terminal feed holes 31*a* on a crimping device 102 to be described later. The terminal chain member 30 is set into the terminal crimping apparatus 100 in a state of being winded up in a reel shape.

Figure 8:
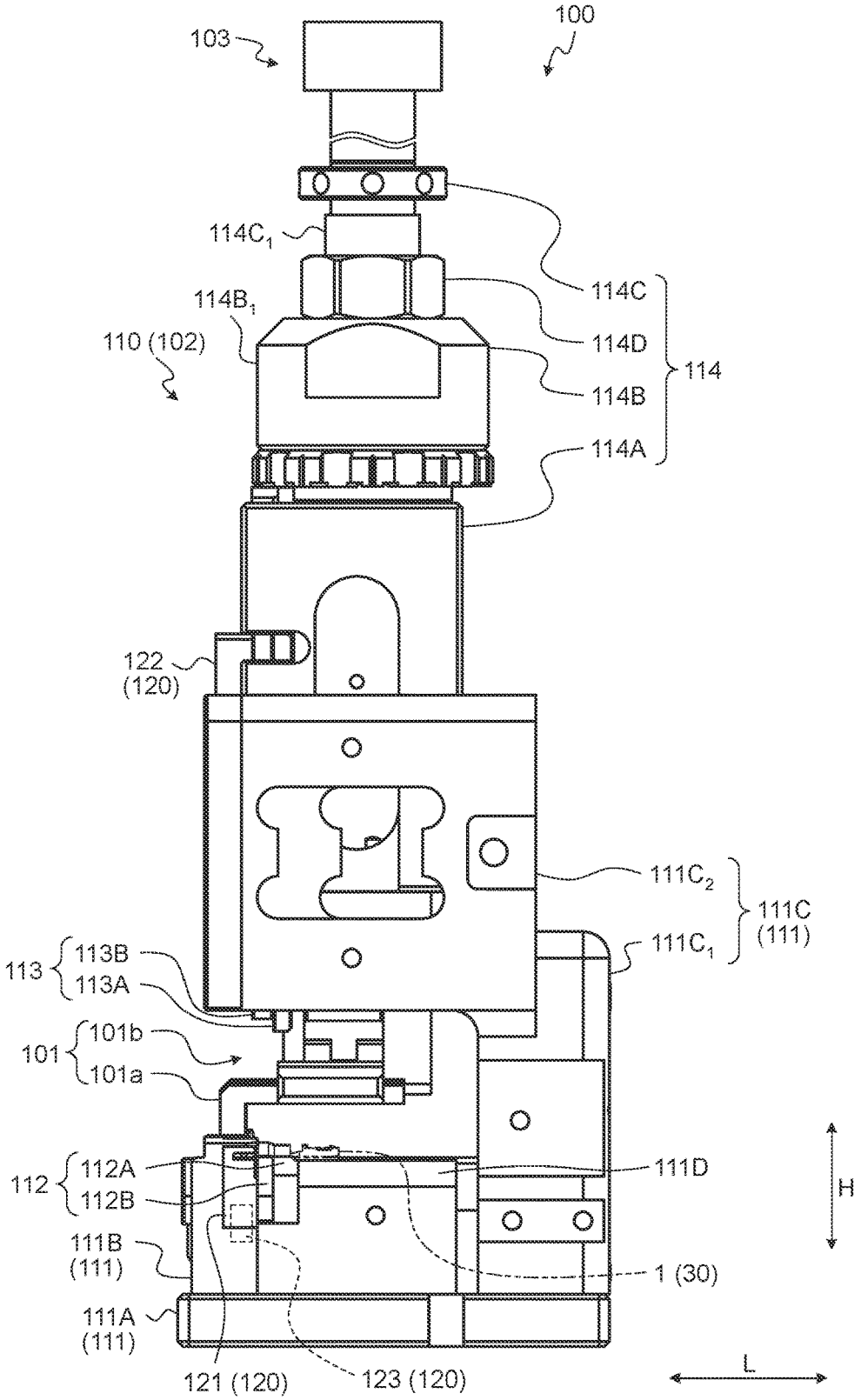
FIG. 8 is a side view of a terminal crimping apparatus according to an embodiment.
Figure 9:
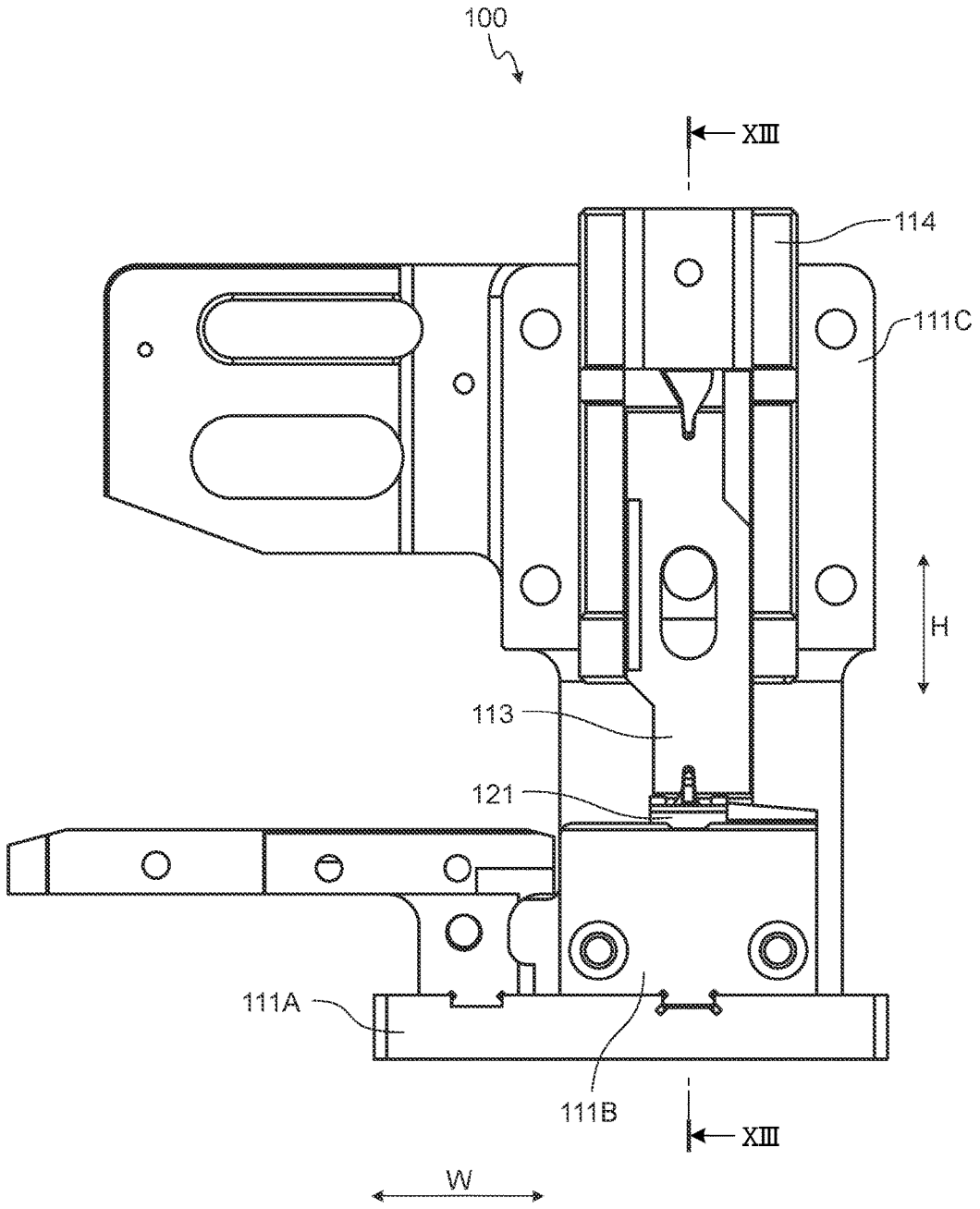
FIG. 9 is a front view of the terminal crimping apparatus according to an embodiment.

As illustrated in FIG. 8, the terminal crimping apparatus 100 includes a terminal supply device 101, the crimping device 102, and a driving device 103. The terminal crimping apparatus 100 is an apparatus referred to as an applicator in this technical field. The terminal supply device 101 is a device that supplies the crimping terminal 1 to a predetermined crimping position. The crimping device 102 is a device that crimps the crimping terminal 1 onto the wire 50 at the predetermined crimping position. The driving device 103 is a device that operates the terminal supply device 101 and the crimping device 102.

The terminal supply device 101 pulls out the terminal chain member 30 winded up in a reel shape, sequentially from the outer peripheral side. The terminal supply device 101 supplies the crimping terminals 1 of the pulled-out terminal chain member 30 to crimping positions, sequentially from the forefront side. When the forefront crimping terminal 1 is crimped onto the wire 50, and cut off from the joint piece 31, the terminal supply device 101 supplies the crimping terminal 1 that newly comes at the forefront, to the crimping position. Each time the crimping process and the terminal cutting process of one crimping terminal 1 are completed, the terminal supply device 101 performs a supply operation to supply the next crimping terminal 1 to the crimping position.

The terminal supply device 101 includes a terminal feed member 101*a* and a power transmission mechanism 101*b*. The terminal feed member 101*a* includes a protruding portion to be inserted into the terminal feed hole 31*a* of the joint piece 31. The terminal feed member 101*a* moves the terminal chain member 30 in the feed direction in a state in which the protruding portion is inserted into the terminal feed hole 31*a*. The power transmission mechanism 101*b* operates the terminal feed member 101*a* in conjunction with a crimping operation performed by the crimping device 102 (up-and-down movement of a ram 114A or the like that is to be described later). The terminal supply device 101 supplies the crimping terminal 1 to the crimping position by moving the terminal feed member 101*a* in the up-down direction and the feed direction in conjunction with the crimping operation of the crimping device 102.

The crimping device 102 executes the crimping process of crimping the supplied crimping terminal 1 onto the wire 50, and a cutting process of cutting off the crimping terminal 1 from the joint piece 31. The crimping device 102 includes a crimping machine 110 and a terminal cutting mechanism 120.

The crimping machine 110 is a device that crimps the crimping terminal 1 onto the wire 50 by swaging the crimping terminal 1 to the end portion of the wire 50. The crimping machine 110 of the present embodiment crimps the crimping terminal 1 onto the wire 50 by swaging the first barrel piece portion 15 and the second barrel piece portion 16 of the crimping terminal 1 so as be winded around the core wire 51 and the covering 52 of the wire 50. The crimping machine 110 includes a frame 111, a first mold 112, a second mold 113, and a power transmission mechanism 114.

The frame 111 includes a base 111A, an anvil supporting member 111B, a transmission portion supporting member 111C, and a support base 111D. The base 111A is a member serving as a basis of the terminal crimping apparatus 100. The base 111A is fixed to a placement base on which the terminal crimping apparatus 100 is to be placed. The anvil supporting member 111B, the transmission portion supporting member 111C, and the support base 111D are fixed onto the base 111A.

The transmission portion supporting member 111C is disposed on the rear side (right side on a paper surface in FIG. 8) and on the upper side (upper side on the paper surface in FIG. 8) of the anvil supporting member 111B. More specifically, the transmission portion supporting member 111C includes a standing portion 111$C_1$ and a ram supporting portion 111$C_2$. The standing portion 111$C_1$ is disposed on the rear side of the anvil supporting member 111B, and is vertically standing upward from the base 111A. The ram supporting portion 111$C_2$ is held on the upper side of the standing portion 111$C_1$. The ram supporting portion 111$C_2$ is a supporting portion that supports the ram 114A to be described later. The ram supporting portion 111$C_2$ is disposed on the upper side of the anvil supporting member 111B, at a predetermined interval from the anvil supporting member 111B. The support base 111D is a base that supports the terminal connection portion 11 of the crimping terminal 1. A height position of the top surface of the support base 111D is a position substantially similar to a height position of the top surface of the first mold 112.

Figure 10:
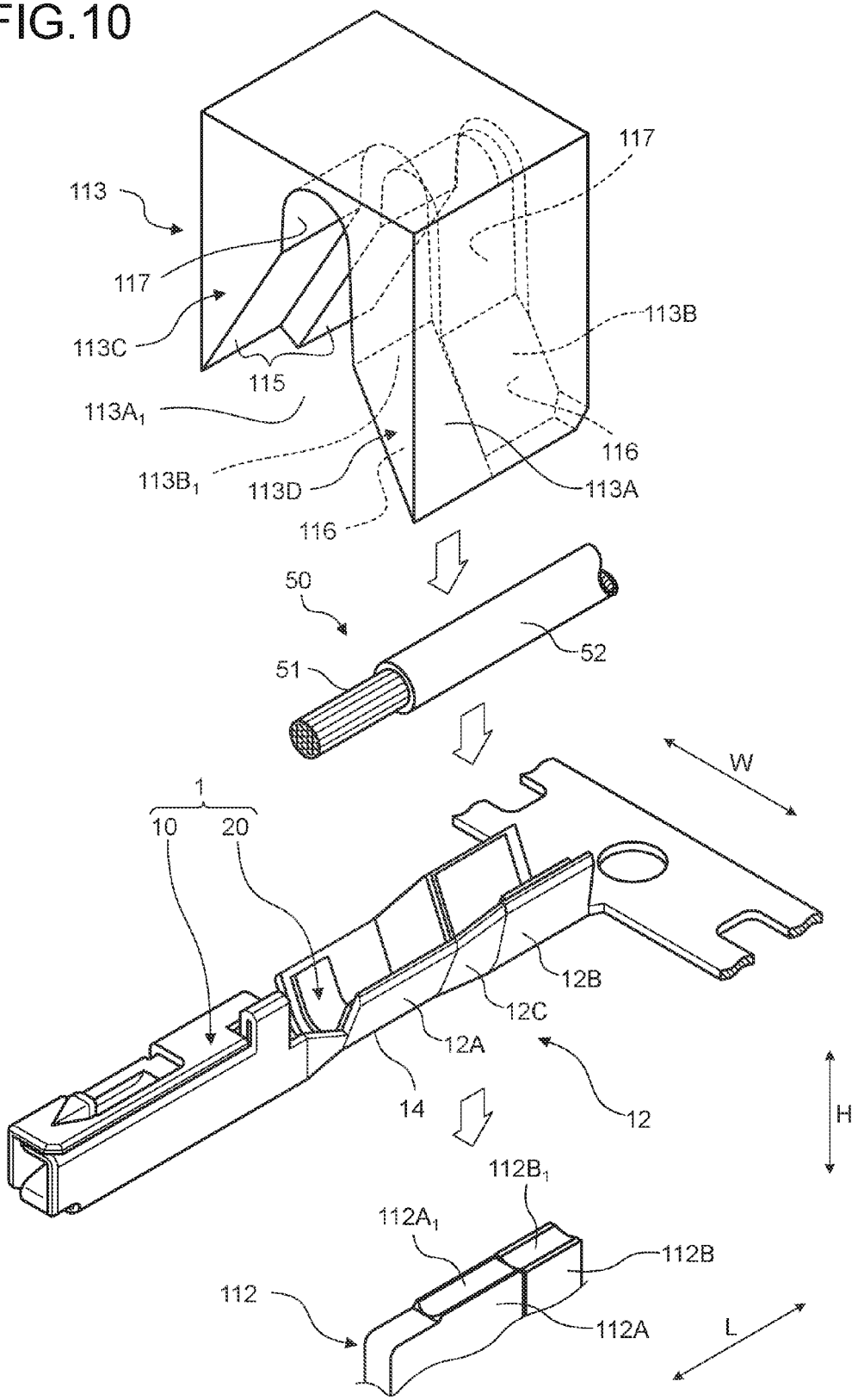
FIG. 10 is a perspective view illustrating first and second molds according to an embodiment.

The first mold 112 and the second mold 113 form a pair. The first mold 112 and the second mold 113 are disposed at an interval in the up-down direction. As illustrated in FIG. 10, the first mold 112 and the second mold 113 crimp the crimping terminal 1 onto the wire 50 by sandwiching the crimping terminal 1 and the wire 50 therebetween. The first mold 112 is a mold that supports the crimping terminal 1 from the lower side. The first mold 112 is formed of two lower molds, and includes a first anvil 112A serving as a first lower mold, and a second anvil 112B serving as a second lower mold. For example, the first anvil 112A and the second anvil 112B are integrally formed. The second mold 113 is disposed on the upper side of the first mold 112. The second mold 113 is formed of two upper molds, and includes a first crimper 113A serving as a first upper mold, and a second crimper 113B serving as a second upper mold.

The first anvil 112A and the first crimper 113A face each other in the up-down direction. The first anvil 112A and the first crimper 113A crimp the core wire crimping portion 12A. More specifically, the first anvil 112A and the first crimper 113A wind the U-shaped core wire crimping portion 12A around the core wire 51 of the wire 50 to crimp the core wire crimping portion 12A onto the core wire 51, by narrowing a distance therebetween.

The second anvil 112B and the second crimper 113B face each other in the up-down direction. The second anvil 112B and the second crimper 113B crimp the covering crimping portion 12B. More specifically, the second anvil 112B and the second crimper 113B wind the U-shaped covering crimping portion 12B around the covering 52 to crimp the covering crimping portion 12B onto the covering 52, by narrowing a distance therebetween.

In the crimping process, by transmitting power to the power transmission mechanism 114, the driving device 103 narrows a distance between the first mold 112 and the second mold 113 to crimp the wire connection portion 12 onto the wire 50. On the other hand, when the crimping process is completed, the driving device 103 widens the distance between the first mold 112 and the second mold 113. In the crimping device 102 of the present embodiment, a distance between the pair of molds 112 and 113 changes by the second mold 113 moving up and down with respect to the first mold 112.

In addition, in the first mold 112, the first anvil 112A and the second anvil 112B may be separately formed, and in the second mold 113, the first crimper 113A and the second crimper 113B may be separately formed. In this case, the driving device 103 and the power transmission mechanism 114 may be configured to separately move the first crimper 113A and the second crimper 113B up and down.

The power transmission mechanism 114 transmits power output from the driving device 103, to the first crimper 113A and the second crimper 113B. As illustrated in FIG. 8, the power transmission mechanism 114 includes the ram 114A, a ram bolt 114B, and a shank 114C.

The ram 114A is a movable member supported so as to be movable up and down with respect to the ram supporting portion 111$C_2$. The second mold 113 is fixed to the ram 114A. Thus, the first crimper 113A and the second crimper 113B move up and down integrally with the ram 114A, with respect to the ram supporting portion 111$C_2$. For example, the shape of the ram 114A is a parallelepiped. A female screw portion (not illustrated) is formed in the ram 114A. The female screw portion is formed on the inner circumferential surface of a hole in the up-down direction that is formed from an inner side of the ram 114A toward an upper end surface.

The ram bolt 114B includes a male screw portion (not illustrated), and the male screw portion is screwed with the female screw portion of the ram 114A. Thus, the ram bolt 114B moves up and down integrally with the ram 114A, with respect to the ram supporting portion 111$C_2$. In addition, the ram bolt 114B includes a bolt head portion 114$B_1$ disposed on the upper side of the male screw portion. A female screw portion (not illustrated) is formed in the bolt head portion 114$B_1$. The female screw portion of the bolt head portion 114$B_1$ is formed on the inner circumferential surface of a hole in the up-down direction that is formed from an inner side of the bolt head portion 114$B_1$ toward an upper end surface.

The shank 114C is a cylindrically-shaped hollow member, and includes a male screw portion 114$C_1$ and a connection portion (not illustrated) at each end portion. The male screw portion 114$C_1$ of the shank 114C is formed on the lower side of the hollow member, and is screwed with the female screw portion of the bolt head portion 114$B_1$ of the ram bolt 114B. Thus, the shank 114C moves up and down integrally with the ram 114A and the ram bolt 114B, with respect to the ram supporting portion 111$C_2$. The connection portion of the shank 114C is connected to the driving device 103.

The driving device 103 includes a driving source (not illustrated), and a power conversion mechanism (not illustrated) that converts drive power of the driving source into power in the up-down direction. The connection portion of the shank 114C is joined to an output shaft of the power conversion mechanism. Thus, the first crimper 113A and the second crimper 113B move up and down integrally with the ram 114A, the ram bolt 114B, and the shank 114C, with respect to the ram supporting portion 111$C_2$, according to an output of the driving device 103 (output of the power conversion mechanism). As the driving source of the driving device 103, an electrical actuator of an electrical motor or the like, a hydraulic actuator of a hydraulic cylinder or the like, an air pressure actuator of an air cylinder or the like, and the like can be applied.

A relative position in the up-down direction of the first crimper 113A with respect to the first anvil 112A, and a relative position in the up-down direction of the second crimper 113B with respect to the second anvil 112B can be changed by adjusting a screw amount of the female screw portion of the bolt head portion 114$B_1$ and the male screw portion 114$C_1$ of the shank 114C. A nut 114D is screwed with the male screw portion 114$C_1$ of the shank 114C on the upper side of the ram bolt 114B. Thus, the nut 114D functions as a so-called locknut together with the female screw portion of the bolt head portion 114$B_1$. By being tightened toward the ram bolt 114B side after the completion of the adjustment of the above-described relative positions, the nut 114D can fix the first crimper 113A and the second crimper 113B at the relative positions.

As illustrated in FIG. 10, recessed surfaces 112$A_1$ and 112$B_1$ recessed downward are formed at the respective upper distal ends of the first anvil 112A and the second anvil 112B. The respective recessed surfaces 112$A_1$ and 112$B_1$ are formed so as to have arc-shaped cross sections, in accordance with the respective shapes of the bottom portion 14 of the U-shaped core wire crimping portion 12A and the U-shaped covering crimping portion 12B. In the crimping machine 110, the recessed surfaces 112$A_1$ and 112$B_1$ each serve as a crimping position. In the crimping terminal 1 supplied with the bottom portion 14 facing downward, the bottom portion 14 of the core wire crimping portion 12A is placed on the recessed surface 112$A_1$ of the first anvil 112A, and the bottom portion 14 of the covering crimping portion 12B is placed on the recessed surface 112$B_1$ of the second anvil 112B. The first mold 112 is supported by the anvil supporting member 111B in a state in which the recessed surfaces 112$A_1$ and 112$B_1$ are exposed upward.

As illustrated in FIG. 10, recessed portions 113$A_1$ and 113$B_1$ recessed upward are respectively formed in the first crimper 113A and the second crimper 113B. The recessed portions 113$A_1$ and 113$B_1$ are disposed to face the respective recessed surfaces 112$A_1$ and 112$B_1$ of the first anvil 112A and the second anvil 112B in the up-down direction. Each of the recessed portions 113$A_1$ and 113$B_1$ includes first and second wall surfaces 115 and 116, and a third wall surface 117. The first wall surface 115 and the second wall surface 116 face each other in the second direction W. The third wall surface 117 links the upper ends of the first and second wall surfaces 115 and 116. While bringing the first to third wall surface 115, 116, and 117 into contact with the first barrel piece portion 15 and the second barrel piece portion 16, each of the recessed portions 113$A_1$ and 113$B_1$ winds the first barrel piece portion 15 and the second barrel piece portion 16 around the end portion of the wire 50 to swage thereonto. Each of the recessed portions 113$A_1$ and 113$B_1$ is formed so as to be able to perform such a swaging operation.

The crimping terminal 1 having been subjected to the crimping processing in the crimping machine 110 is cut off from the joint piece 31 by the terminal cutting mechanism 120. The terminal cutting mechanism 120 cuts the link portion 32 of the crimping terminal 1 supplied to the crimping position by sandwiching the link portion 32 between two terminal cutting portions, and performs the cut off in conjunction with the progress of the crimping process. As illustrated in FIG. 8, the terminal cutting mechanism 120 is disposed on the front side (the left side in on the paper surface in FIG. 8) of the second anvil 112B. The terminal cutting mechanism 120 includes a terminal cutting member 121, a pressing member 122, and an elastic member 123.

Figure 11:
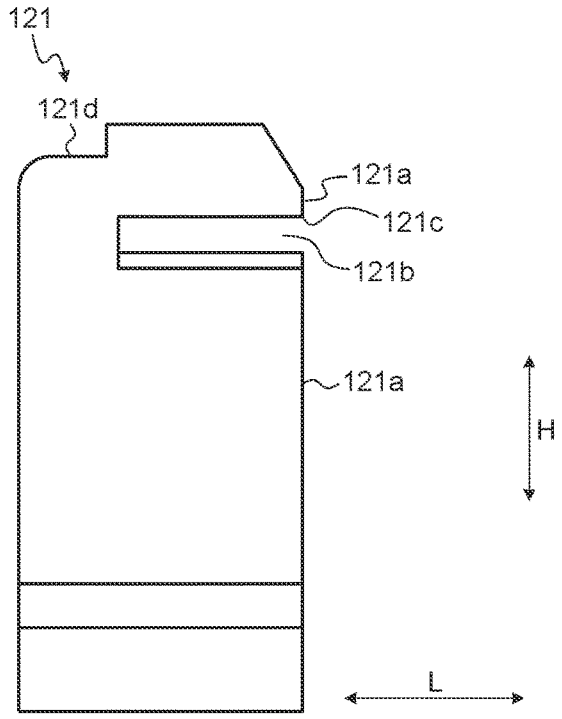
FIG. 11 is a side view illustrating a terminal cutting member according to an embodiment.

The terminal cutting member 121 is formed into a parallelepiped, and is disposed so as to be slidable in the up-down direction along the front surface of the second anvil 112B. As illustrated in FIGS. 11 and 12, a slit 121*b* is formed in the terminal cutting member 121 from a sliding contact surface 121*a* with the second anvil 112B toward the inside. The slit 121*b* is a pathway of the joint piece 31 of the terminal chain member 30. When the crimping target crimping terminal 1 is supplied to the crimping position, the crimping terminal 1 protrudes from the slit 121*b*. The crimping terminal 1 supplied to the crimping position is supported by the first mold 112 from the lower side.

The terminal cutting member 121 cuts the link portion 32 while relatively moving up and down with respect to the first mold 112 and the crimping terminal 1. Here, a position at which the joint piece 31 and the like can be inserted into the slit 121*b* is assumed to be a default position in the up-down direction of the terminal cutting member 121. As illustrated in FIG. 13, an end portion on the wire connection portion 12 side of the link portion 32 is positioned in an opening on the sliding contact surface 121*a* side (i.e., the crimping terminal 1 side) of the slit 121*b*. In the terminal cutting member 121, an edge portion (hereinafter, referred to as an "opening edge".) 121*c* on the upper side in the opening is used as one terminal cutting portion. The other terminal cutting portion is a top surface edge 112*a* of the second anvil 112B.

The pressing member 122 is fixed to the ram 114A, and moves up and down integrally with the ram 114A. The pressing member 122 is disposed on the upper side of the terminal cutting member 121, and presses down the terminal cutting member 121 by lowering. The pressing member 122 is formed into a parallelepiped. The elastic member 123 is a member that adds upper biasing force to the terminal cutting member 121, and is formed of a spring member or the like. The elastic member 123 returns the terminal cutting member 121 to the default position in the up-down direction when pressing force applied from the pressing member 122 is released.

In the terminal cutting mechanism 120, the pressing member 122 lowers together with the lowering of the second mold 113 in the crimping processing, to press down the terminal cutting member 121. By the terminal cutting member 121 lowering, the link portion 32 is sandwiched between the opening edge 121*c* of the slit 121*b* and the top surface edge 112*a* (FIG. 13) of the second anvil 112B. In the terminal cutting mechanism 120, the opening edge 121*c* and the top surface edge 112*a* function as scissors, and add shearing force to the link portion 32. By the terminal cutting member 121 being further pressed down, the opening edge 121*c* and the top surface edge 112*a* cut the link portion 32, and cut off the crimping terminal 1 from the joint piece 31. In addition, for enhancing cutting performance, the opening edge 121*c* is inclined on the sliding contact surface 121*a* with respect to the top surface edge 112*a*.

As illustrated in FIG. 13, the crimping target wire 50 is disposed at a predetermined position located between the terminal cutting member 121 and the pressing member 122. More specifically, the wire 50 is placed on a top surface 121*d* of the terminal cutting member 121. Thus, a space for letting the wire 50 escape is provided in at least one of an upper portion of the terminal cutting member 121 and a lower portion of the pressing member 122 so that the wire 50 is not squished therebetween.

Here, the predetermined position is a position at which the end portion of the wire 50 not having been subjected to the crimping processing exists on the upper side of the bottom portion 14 of the flat-plate-shaped wire connection portion 12. In addition, the predetermined position is a position at which the core wire 51 can be placed on the bottom portion 14 of the core wire crimping portion 12A so that the distal end of the core wire 51 that has been pressed down at the start of the crimping processing does not protrude from the core wire crimping portion 12A. The core wire 51 extends in an axis line direction in accordance with the crimping processing, and a distal end position of the core wire 51 sometimes moves in the axis line direction. The predetermined position is desirably determined in consideration of the extension.

On the other hand, the end portion (the core wire 51 at the distal end and the covering 52) of the wire 50 is pressed down by the second mold 113 toward the inner wall surface side of the wire connection portion 12. Thus, if no holding is provided, the wire 50 is uplifted from the top surface 121*d* of the terminal cutting member 121, and the core wire 51 at the distal end and the covering 52 may be crimped in a state of not being placed on the bottom portion 14 of the wire connection portion 12. Thus, the terminal crimping apparatus 100 of the present embodiment is provided with a wire holding mechanism that holds the wire 50 at the predetermined position between itself and the upper portion of the terminal cutting member 121, and suppresses a position shift of the end portion of the wire 50 with respect to the wire connection portion 12 that occurs in the crimping processing.

The wire holding mechanism includes a wire retaining member 118 (FIG. 13) that retains the wire 50 placed on the top surface 121*d* of the terminal cutting member 121 that serves as a wire placement portion, by pressing the wire 50 against the top surface 121*d*. The wire retaining member 118 is disposed on the upper side of the terminal cutting member 121, and between the second mold 113 and the pressing member 122. A space (hereinafter, referred to as a "wire holding space".) 118A for holding the covering 52 of the wire 50 is formed between the top surface 121*d* of the terminal cutting member 121 and the bottom surface of the wire retaining member 118. The wire holding space 118A suppresses the uplift of the wire 50 from the top surface 121*d* of the terminal cutting member 121 that occurs in the crimping process, and suppresses a position shift of the core wire 51 at the distal end and the covering 52 with respect to the wire connection portion 12. The wire retaining member 118 is a member that can move up and down with respect to the top surface 121*d* of the terminal cutting member 121, and forms the wire holding space 118A between itself and the upper portion of the terminal cutting member 121 by lowering. For example, the wire retaining member 118 is fixed to the ram 114A, and moves up and down integrally with the ram 114A. The wire 50 is held in the wire holding space 118A formed in accordance with the lowering of the wire retaining member 118.

The terminal crimping apparatus 100 of the present embodiment includes a supporting stopper 119. The supporting stopper 119 supports the terminal connection portion 11 of the crimping terminal 1 in the crimping process. The supporting stopper 119 is disposed at a position facing the terminal connection portion 11 in the third direction H. The supporting stopper 119 is a member being supported by the ram 114A, and moving integrally with the ram 114A. The supporting stopper 119 lowers in conjunction with the lowering of the ram 114A, to cover the terminal connection portion 11 from the upper side. The supporting stopper 119 covering the terminal connection portion 11 supports the terminal connection portion 11, and suppresses a movement such as rolling and twist of the terminal connection portion 11. Here, the rolling refers to a movement of rotation around an axis extending in the first direction L, and the twist refers to a movement of inclining with respect to the first direction L.

Figure 14:
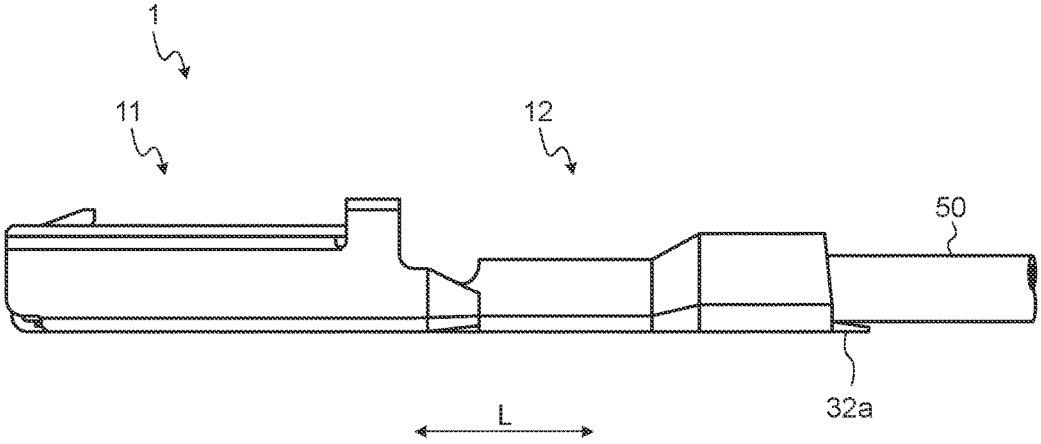
FIG. 14 is a side view illustrating a cutoff remaining in the crimping terminal.

As described above, the terminal crimping apparatus 100 according to the present embodiment crimps the wire connection portion 12 onto the wire 50, and cuts the crimping terminal 1 from the terminal chain member 30. Here, as illustrated in FIG. 14, if a cutoff 32*a* being a part of the link portion 32 is remaining in the crimping terminal 1 cut off from the terminal chain member 30, the below-described problem sometimes occurs. When the crimping terminal 1 is crimped onto the wire 50, the wire connection portion 12 extends in the first direction L. In addition to the extension of the wire connection portion 12, the cutoff 32*a* remains in the wire connection portion 12. This may cause the cutoff 32*a* to protrude from a terminal accommodation portion. For example, the terminal accommodation portion is a cavity formed in an electrical connection box or the like. It is not desirable that the cutoff 32*a* protrudes from the terminal accommodation portion in a state in which the crimping terminal 1 is accommodated in the terminal accommodation portion.

The terminal crimping apparatus 100 of the present embodiment is configured to cut a boundary with the crimping terminal 1 in the link portion 32. As illustrated in FIG. 15, the terminal cutting mechanism 120 of the terminal crimping apparatus 100 cuts off the crimping terminal 1 so as to make the cutoff 32*a* substantially zero. This suppresses the protrusion of the cutoff 32*a* from the terminal accommodation portion. Furthermore, the second mold 113 of the terminal crimping apparatus 100 of the present embodiment is configured to be able to eliminate swaging remainder of the wire connection portion 12 as described below.

First of all, the terminal cutting mechanism 120 will be described with reference to FIG. 16. The top surface edge 112*a* of the first mold 112 is provided on the recessed surface 112$B_1$ serving as a supporting surface that supports the crimping terminal 1. The top surface edge 112*a* is an edge portion provided at an end portion on the terminal cutting member 121 side of the recessed surface 112$B_1$. The opening edge 121*c* of the terminal cutting member 121 is an edge portion provided at an end portion on the first mold 112 side of the slit 121*b*. The top surface edge 112*a* and the opening edge 121*c* cut a boundary 32*b* with the crimping terminal 1 in the link portion 32.

The terminal supply device 101 supplies the terminal chain member 30 to a position at which the boundary 32*b* of the link portion 32 faces the top surface edge 112*a* and the opening edge 121*c* in the third direction H, so as to be able to cut the boundary 32*b* in the terminal cutting process of cutting the link portion 32. In other words, the crimping position in the present embodiment is a position at which the boundary 32*b* is located between the top surface edge 112*a* and the opening edge 121*c*. In addition, the crimping position may be defined in consideration of extension of the wire connection portion 12 in the crimping process. More specifically, the crimping position may be defined so as to be a position at which the position of the boundary 32*b* that is set when the terminal cutting process is executed faces the opening edge 121*c*, as a result of the extension of the wire connection portion 12.

When the terminal cutting member 121 lowers in conjunction with the lowering of the second mold 113 in the terminal cutting process, the opening edge 121*c* comes into contact with the boundary 32*b* from the upper side. While lowering in conjunction with the lowering of the second mold 113, the opening edge 121*c* cuts the boundary 32*b* together with the top surface edge 112*a*. The opening edge 121*c* cuts the boundary 32*b* by adding shearing force to the boundary 32*b* in cooperation with the top surface edge 112*a*.

Figure 17:
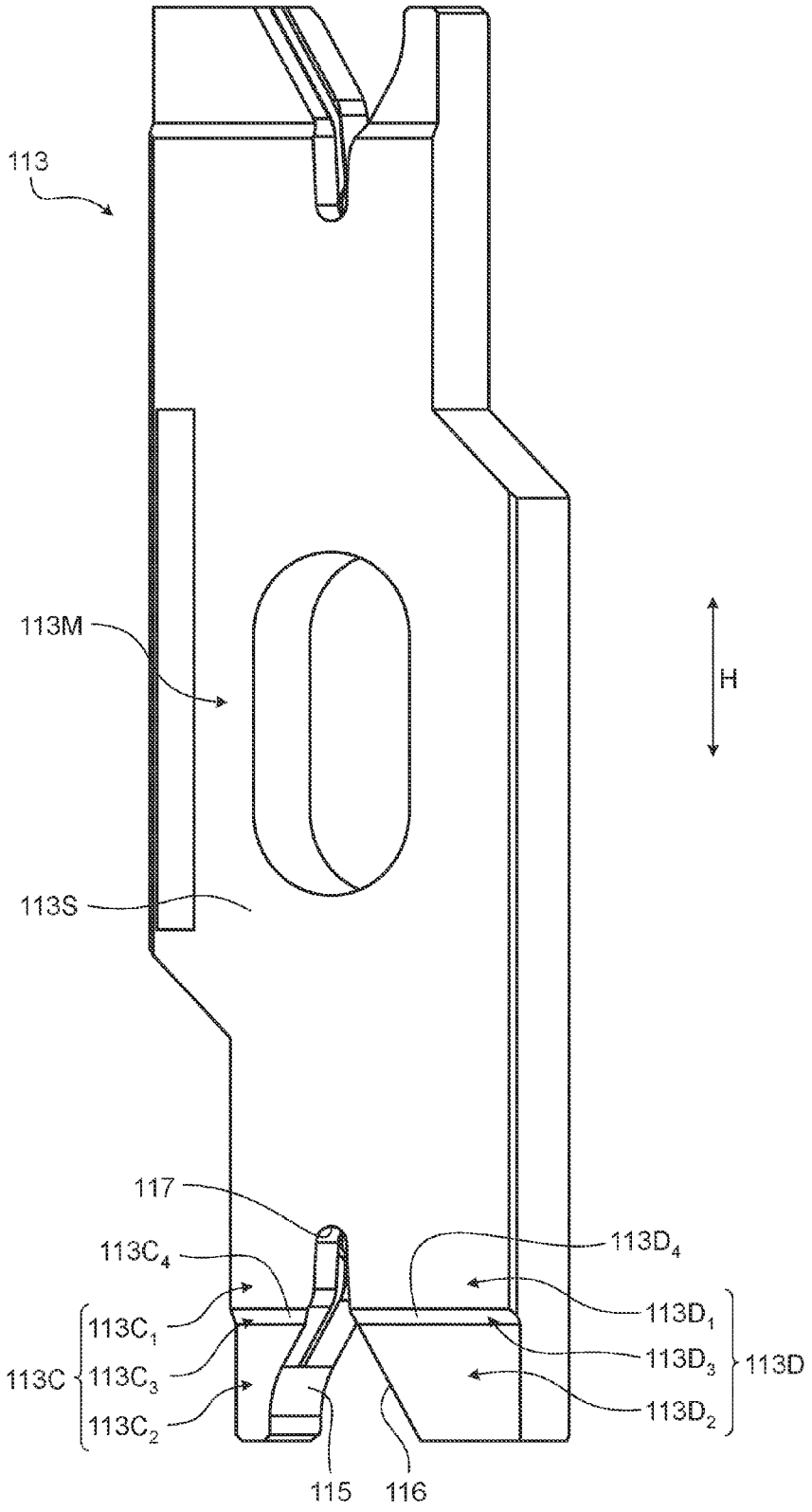
FIG. 17 is a perspective view of the second mold according to the present embodiment.
Figure 18:
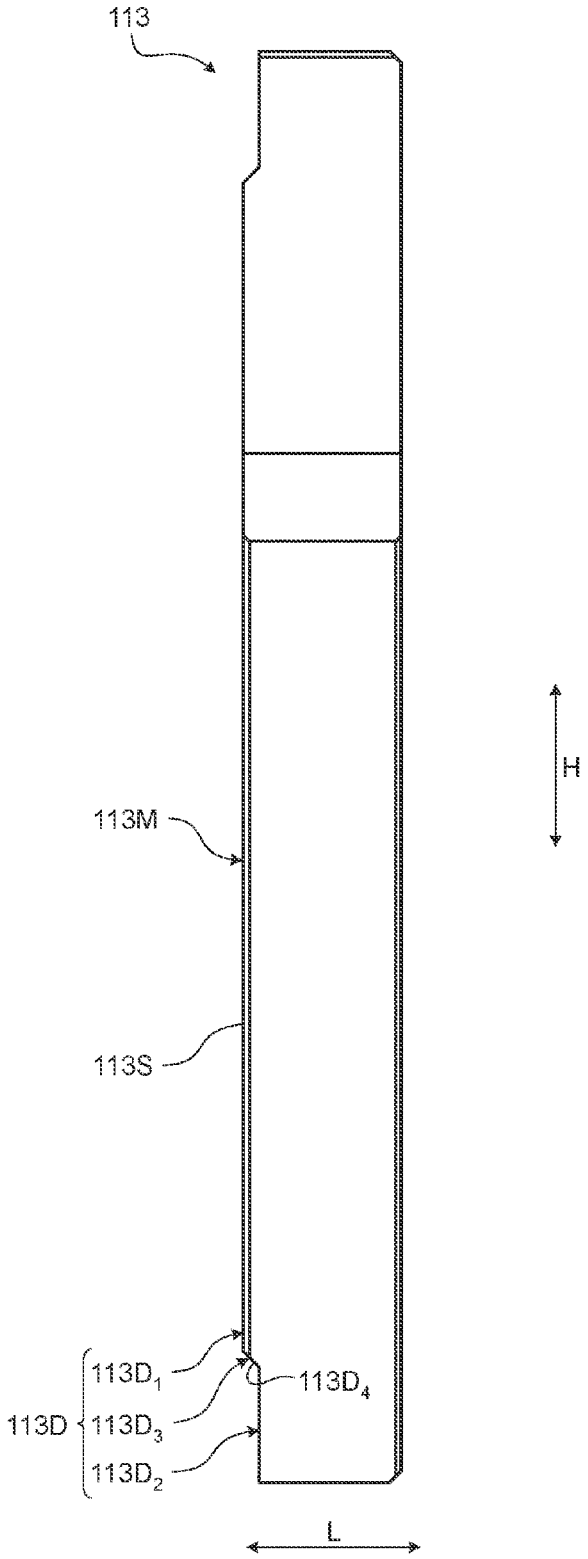
FIG. 18 is a side view of the second mold according to the present embodiment.
Figure 19:
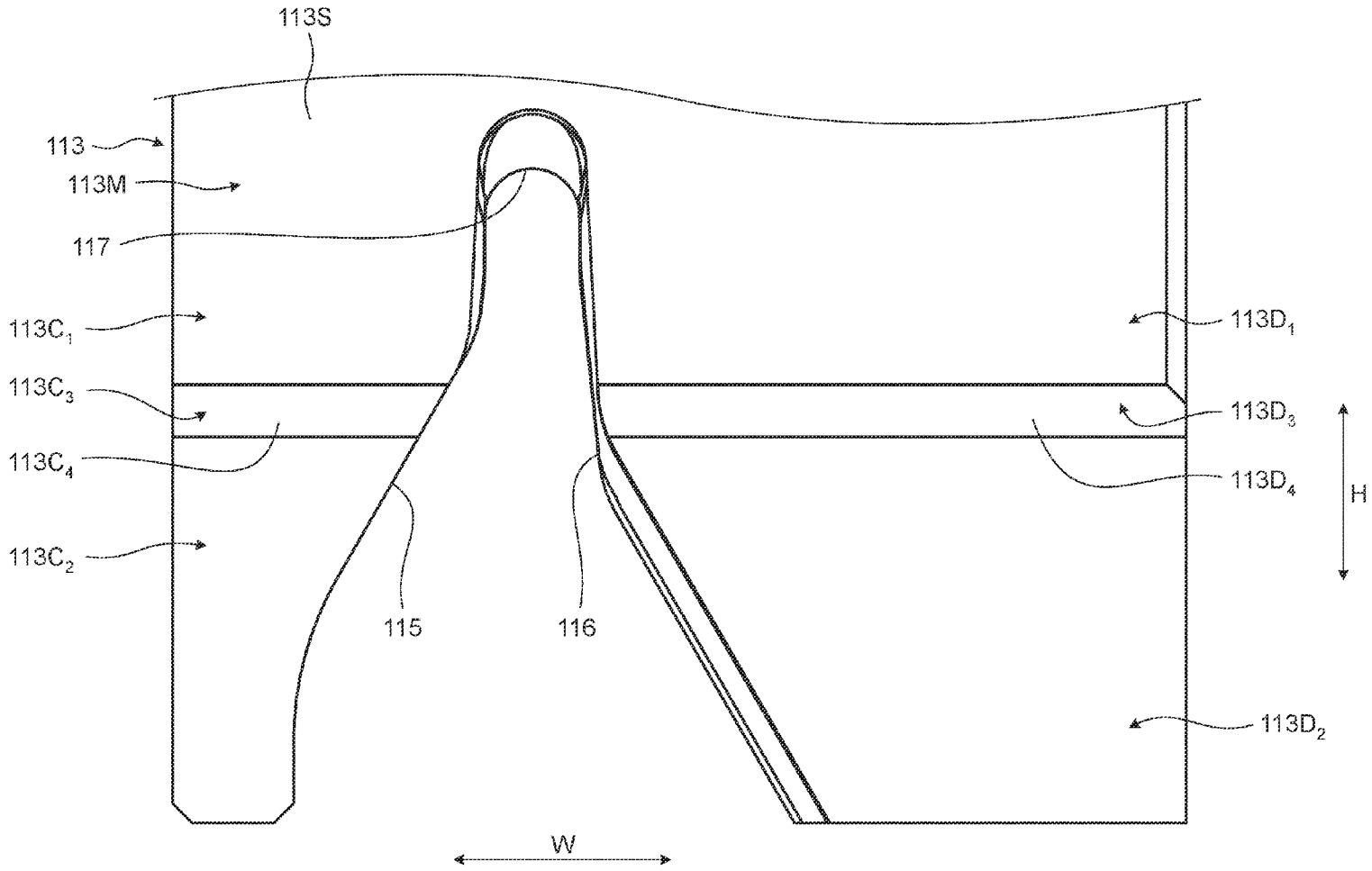
FIG. 19 is a front view of the second mold according to the present embodiment.

The second mold 113 will be described with reference to FIGS. 17 to 19. As illustrated in FIGS. 17 to 19, the second mold 113 includes a main body 113M, a first wall portion 113C, and a second wall portion 113D. In addition, in this specification, the first wall portion 113C and the second wall portion 113D are sometimes collectively referred to as "a pair of wall portions 113C and 113D". The main body 113M is a main portion of the second mold 113, and is an oblong-flat-plate-shaped component. The first wall portion 113C and the second wall portion 113D protrude from the main body 113M. In a state of being mounted on the terminal crimping apparatus 100, the first wall portion 113C and the second wall portion 113D protrude toward the first mold 112, that is, protrude downward. As illustrated in FIG. 19, the first wall portion 113C and the second wall portion 113D face each other in the second direction W. In other words, the pair of wall portions 113C and 113D face each other in an arrangement direction of the crimping terminals 1 in the terminal chain member 30. As described with reference to FIG. 10, the pair of wall portions 113C and 113D come into contact with the wire connection portion 12 of the crimping terminal 1 in the crimping process to bend the wire connection portion 12.

The pair of wall portions 113C and 113D respectively include proximal end portions 113$C_1$ and 113$D_1$ and hem portions 113$C_2$ and 113$D_2$. The proximal end portions 113$C_1$ and 113$D_1$ are portions provided on the main body 113M side in the pair of wall portions 113C and 113D. The hem portions 113$C_2$ and 113$D_2$ are portions provided closer to the distal end side than the proximal end portions 113$C_1$ and 113$D_1$ in the pair of wall portions 113C and 113D. The plate thickness of the hem portions 113$C_2$ and 113$D_2$ is made thinner than that of the proximal end portions 113$C_1$ and 113$D_1$. In accordance with the change in plate thickness, a level difference is formed on a front surface 113S of the second mold 113 from the proximal end portions 113$C_1$ and 113$D_1$ toward the hem portions 113$C_2$ and 113$D_2$. In addition, the front surface 113S is a surface on the terminal cutting member 121 side.

More specifically, the pair of wall portions 113C and 113D are respectively provided with intermediate portions 113$C_3$ and 113$D_3$ linking the proximal end portions 113$C_1$ and 113$D_1$ and the hem portions 113$C_2$ and 113$D_2$. The intermediate portions 113$C_3$ and 113$D_3$ have a plate thickness getting thinner from the proximal end portions 113$C_1$ and 113$D_1$ toward the hem portions 113$C_2$ and 113$D_2$. In accordance with the change in plate thickness, portions on the front surface 113S that correspond to the intermediate portions 113$C_3$ and 113$D_3$ are inclined surfaces 113$C_4$ and 113$D_4$. The inclined surfaces 113$C_4$ and 113$D_4$ are inclined to be oriented obliquely downward.

The positional relationship in the first direction L between the regions in the terminal crimping apparatus 100 of the present embodiment will be described with reference to FIG. 16. As illustrated in FIG. 16, the position in the first direction L of the boundary 32*b* of the link portion 32 is the same as the position of the top surface edge 112*a*. Thus, the top surface edge 112*a* comes into contact with the boundary 32*b* from the lower side in the terminal cutting process. The position in the first direction L of the opening edge 121*c* is the same position as the position of the boundary 32*b* of the link portion 32, or a position slightly shifted from the boundary 32*b* toward the joint piece 31 side. The opening edge 121*c* comes into contact with the boundary 32*b* from the upper side in the terminal cutting process.

The positional relationship between the regions in the second mold 113, and the regions in the first mold 112 and the terminal cutting member 121 will be described. In addition, FIG. 16 illustrates the positional relationship between the first mold 112 and the terminal cutting member 121, and the first wall portion 113C out of the pair of wall portions 113C and 113D. The second wall portion 113D has positional relationship similar to the first wall portion 113C.

The main body 113M of the second mold 113 and the proximal end portion 113$C_1$ of the first wall portion 113C protrude more than the top surface edge 112*a* toward the terminal cutting member 121 side. In other words, the main body 113M and the proximal end portion 113$C_1$ jut more than a range in which the recessed surface 112$B_1$ exists, toward the terminal cutting member 121 side. In other words, the third wall surface 117 and the first wall surface 115 of the proximal end portion 113$C_1$ jut more than the top surface edge 112*a* toward the terminal cutting member 121 side.

For example, the main body 113M and the proximal end portion 113$C_1$ may protrude at least to the position of the opening edge 121*c* toward the terminal cutting member 121 side. Alternatively, the main body 113M and the proximal end portion 113$C_1$ may protrude toward the terminal cutting member 121 side to exceed the position of the opening edge 121*c*. In the present embodiment, as illustrated in FIG. 16, the main body 113M and the proximal end portion 113$C_1$ protrude toward the terminal cutting member 121 side to exceed the position of the opening edge 121*c*.

For example, a protrusion amount toward the terminal cutting member 121 side is defined according to an extension amount of the crimping terminal 1 in the crimping process. The terminal crimping apparatus 100 of the present embodiment performs the terminal cutting process concurrently with the crimping process. The terminal crimping apparatus 100 performs the crimping of the wire connection portion 12 with respect to the wire 50 even after cutting the link portion 32 in the terminal cutting process. Because the wire connection portion 12 extends in the first direction L even after the completion of the terminal cutting process, the end portion of the wire connection portion 12 is considered to protrude from the recessed surface 112$B_1$ toward the terminal cutting member 121 side. When the link portion 32 is cut at the boundary 32*b* with the wire connection portion 12 as in the present embodiment, the wire connection portion 12 is considered to easily protrude from the recessed surface 112$B_1$ toward the terminal cutting member 121 side. If the second mold 113 fails to correspond to the extension of the wire connection portion 12, swaging remainder of the wire connection portion 12 may occur.

In view of this, in the second mold 113 of the present embodiment, the main body 113M and the proximal end portion 113$C_1$ protrude more than the top surface edge 112*a* toward the terminal cutting member 121 side. In addition, the proximal end portion 113$D_1$ of the second wall portion 113D also protrudes more than the top surface edge 112*a* toward the terminal cutting member 121 side similarly to the proximal end portion 113$C_1$, which is not illustrated in FIG. 16. Thus, even if the wire connection portion 12 protrudes from the recessed surface 112$B_1$ toward the terminal cutting member 121 side in the crimping process, the protruding portion is crimped by the second mold 113 onto the wire 50. The swaging remainder of the wire connection portion 12 can be thereby eliminated.

In addition, as illustrated in FIG. 16, the hem portion 113$C_2$ of the second mold 113 is positioned closer to the first mold 112 side than the top surface edge 112*a*. In other words, the hem portion 113$C_2$ is not protruding more than the top surface edge 112*a* toward the terminal cutting member 121 side. Similarly, the hem portion 113$D_2$ of the second wall portion 113D is positioned closer to the first mold 112 side than the top surface edge 112*a*. Because the hem portions 113$C_2$ and 113$D_2$ of the second mold 113 are provided closer to the first mold 112 side than the top surface edge 112*a*, interference between the second mold 113 and the terminal cutting member 121 is prevented from occurring.

A range in which the hem portions 113$C_2$ and 113$D_2$ are provided is defined so that the terminal cutting member 121 and the second mold 113 do not interfere with each other even if they relatively move. In the terminal crimping apparatus 100 of the present embodiment, at the initial stage at which the second mold 113 starts to lower, the terminal cutting member 121 remains at rest, and the second mold 113 relatively moves downward with respect to the terminal cutting member 121. If a lowering distance of the second mold 113 becomes a predetermined distance or more, the terminal cutting member 121 starts to lower in conjunction with the lowering of the second mold 113. The hem portions 113$C_2$ and 113$D_2$ are provided in a range set according to a distance of a relative movement of the second mold 113 with respect to the terminal cutting member 121 at the initial stage of the lowering. More specifically, an installation range of the hem portions 113$C_2$ and 113$D_2$ is defined so that the second mold 113 does not collide with the terminal cutting member 121 in a period in which the second mold 113 relatively moves with respect to the terminal cutting member 121.

In this manner, the terminal crimping apparatus 100 of the present embodiment can cut the boundary 32*b* of the link portion 32, and eliminate the swaging remainder of the wire connection portion 12 without causing interference between the second mold 113 and the terminal cutting member 121.

As described above, the terminal crimping apparatus 100 of the present embodiment includes the terminal supply device 101, the first mold 112, the second mold 113, and the terminal cutting member 121. The terminal crimping apparatus 100 supplies the terminal chain member 30 including the plurality of crimping terminals 1 arranged in parallel, the joint piece 31 extending in the second direction W being the arrangement direction of the plurality of crimping terminals 1, and the link portions 32 linking one ends of the crimping terminals 1 and the joint piece 31. The first mold 112 includes the recessed surface 112$B_1$ (supporting surface) that supports the crimping terminal 1 supplied by the terminal supply device 101, and the top surface edge 112*a* (first edge portion) provided at one end of the recessed surface 112$B_1$.

The second mold 113 is disposed to face the recessed surface 112$B_1$, and crimps the crimping terminal 1 onto the wire 50 by sandwiching the crimping terminal 1 and the wire 50 between itself and the recessed surface 112$B_1$ while relatively moving with respect to the recessed surface 112$B_1$. The terminal cutting member 121 is disposed adjacently to the first mold 112, and includes the opening edge 121*c* (second edge portion) corresponding to the top surface edge 112*a*.

The terminal cutting member 121 cuts the boundary 32*b* with the crimping terminal 1 in the link portion 32 in cooperation with the top surface edge 112*a* using the opening edge 121*c*, while relatively moving with respect to the first mold 112 in the same direction as the movement of the second mold 113. The second mold 113 includes the main body 113M, and the pair of wall portions 113C and 113D protruding from the main body 113M toward the first mold 112 side and facing each other in the arrangement direction of the crimping terminal 1, and coming into contact with the crimping terminal 1 to bend the crimping terminal 1. The pair of wall portions 113C and 113D include the proximal end portions 113$C_1$ and 113$D_1$ being portions provided on the main body 113M side, and the hem portions 113$C_2$ and 113$D_2$ being portions provided closer to the distal end side than the proximal end portions 113$C_1$ and 113$D_1$.

The main body 113M and the proximal end portions 113$C_1$ and 113$D_1$ protrude more than the top surface edge 112*a* toward the terminal cutting member 121 side. On the other hand, the hem portions 113$C_2$ and 113$D_2$ are positioned closer to the first mold 112 side than the top surface edge 112*a* in the first direction L. By the opening edge 121*c* of the terminal cutting member 121 cutting the boundary 32*b* with the crimping terminal 1 in the link portion 32, the terminal crimping apparatus 100 of the present embodiment can shorten the cutoff 32*a*. In addition, because the hem portions 113$C_2$ and 113$D_2$ of the second mold 113 are positioned closer to the first mold 112 side than the top surface edge 112*a*, that is, positioned on the opposite side of the terminal cutting member 121 side, interference between the second mold 113 and the terminal cutting member 121 is suppressed.

In addition, the hem portions 113$C_2$ and 113$D_2$ of the second mold 113 are provided in a range set according to a movement distance by which the second mold 113 relatively moves with respect to the terminal cutting member 121 when the crimping terminal 1 is crimped. The interference between the second mold 113 and the terminal cutting member 121 in the crimping process can be thereby surely suppressed.

In addition, the material of the core wire 51 of the wire 50 is not limited to aluminum. For example, the core wire 51 may be copper or copper alloy, or another conductive metal. The material of the crimping terminal 1 is not limited to copper and copper alloy, and may be another conductive metal.

First Modified Example of Embodiment

Figure 20:
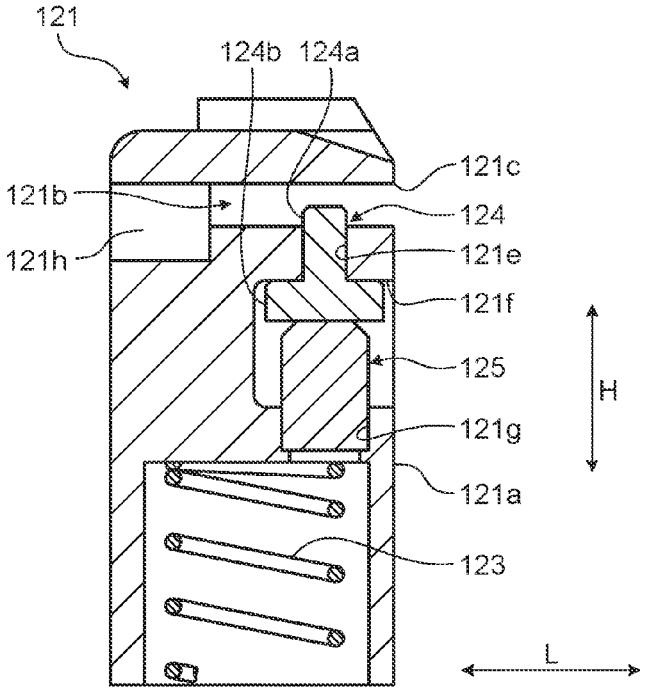
FIG. 20 is a cross-sectional view of a terminal cutting member according to a first modified example of an embodiment.
Figure 21:
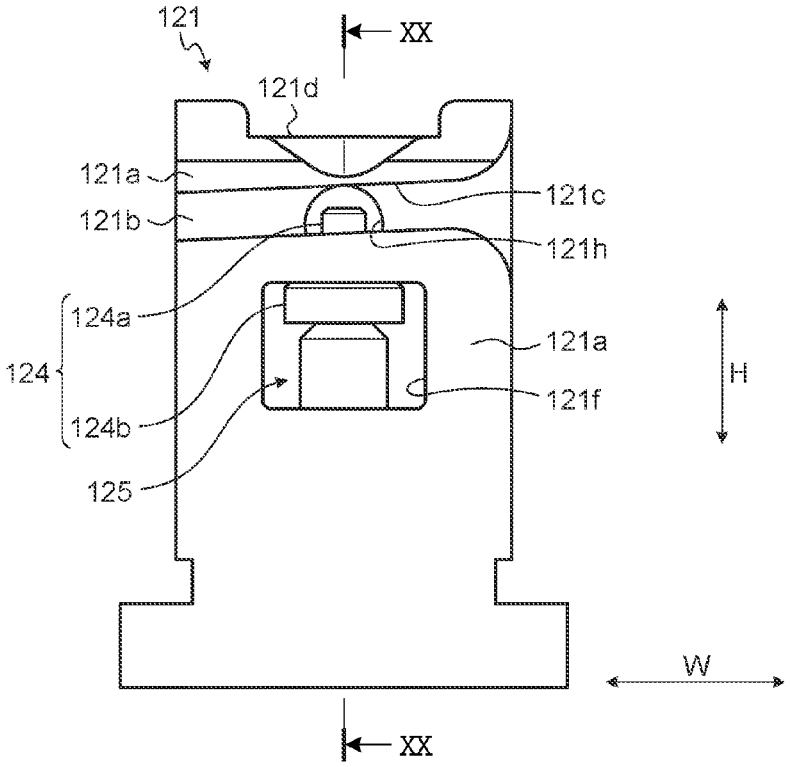
FIG. 21 is a rear view of the terminal cutting member according to the first modified example of an embodiment.

A first modified example of the embodiment will be described. FIG. 20 is a cross-sectional view of a terminal cutting member according to the first modified example of the embodiment, and FIG. 21 is a rear view of the terminal cutting member according to the first modified example of the embodiment. FIG. 20 illustrates a XX-XX cross section in FIG. 21. The terminal cutting member 121 of the first modified example differs from that in the above-described embodiment in that the terminal cutting member 121 includes a pin 124. The pin 124 is a projection portion for positioning the crimping terminal 1 by being inserted into the terminal feed hole 31*a* of the terminal chain member 30.

As illustrated in FIG. 20, the terminal cutting member 121 is provided with a through-hole 121*e*, a recessed portion 121*f*, a screw hole 121*g*, and a through-hole 121*h*. The recessed portion 121*f* is a recessed portion provided on the sliding contact surface 121*a*. For example, the shape of the recessed portion 121*f* is a cuboid shape. The through-hole 121*e* communicates the recessed portion 121*f* and the slit 121*b*. The through-hole 121*e* extends in the third direction H. The screw hole 121*g* communicates the recessed portion 121*f* and a space portion in which the elastic member 123 is disposed. The screw hole 121*g* is provided on the same axis with the through-hole 121*e*, and extends in the third direction H. A screw portion is formed on the inner circumferential surface of the screw hole 121*g*. The through-hole 121*h* communicates a rear portion of the slit 121*b* and an external space of the terminal cutting member 121. As illustrated in FIG. 21, the through-hole 121*h* is provided at a position facing a protruding portion 124*a* of the pin 124.

The pin 124 includes a base portion 124*b*, and the columnar protruding portion 124*a* protruding from the base portion 124*b*. For example, the shape of the protruding portion 124*a* is a columnar shape. The base portion 124*b* of the pin 124 is disposed in the recessed portion 121*f*, and the protruding portion 124*a* is inserted into the through-hole 121*e* from the lower side. The distal end of the protruding portion 124*a* protrudes into the slit 121*b*.

A set screw 125 is screwed with the screw hole 121*g*. A screw portion corresponding to the screw portion of the screw hole 121*g* is provided on the outer circumferential surface of the set screw 125. The upper end of the set screw 125 is in contact with the base portion 124*b* of the pin 124. The set screw 125 is screwed into upward to press the base portion 124*b* toward the upper side wall surface of the recessed portion 121*f*. The pin 124 is supported by the set screw 125, and maintained in a state in which the protruding portion 124*a* is protruding into the slit 121*b*.

Figure 22:
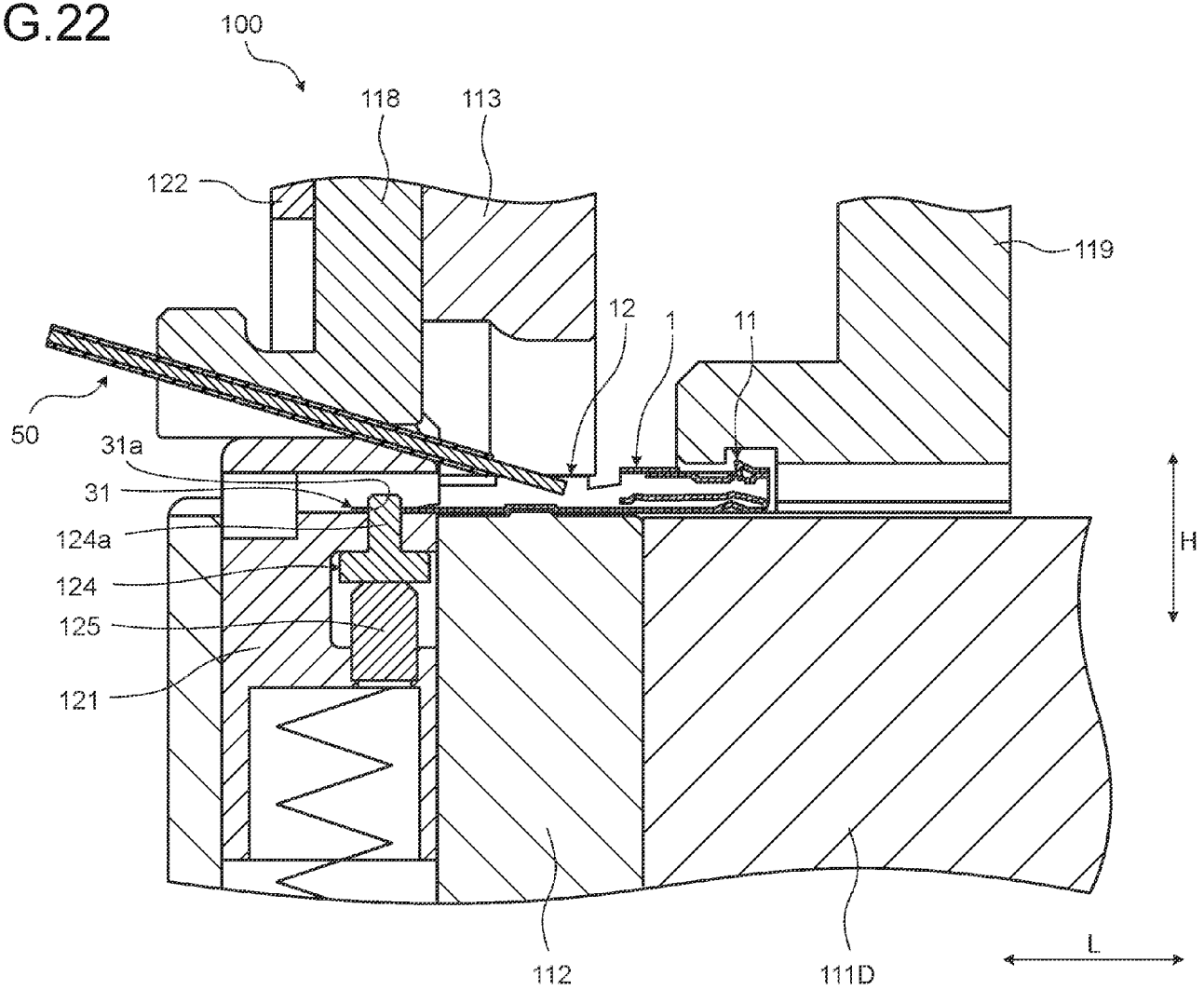
FIG. 22 is a cross-sectional view illustrating a state in which a crimping terminal is supplied to a crimping position.

FIG. 22 illustrates a state in which the crimping terminal 1 is supplied to the crimping position. The wire 50 is held by the top surface of the terminal cutting member 121 and the wire retaining member 118. When the crimping terminal 1 is supplied to the crimping position, the protruding portion 124*a* of the pin 124 enters the terminal feed hole 31*a* of the joint piece 31. By the protruding portion 124*a* being inserted into the terminal feed hole 31*a*, the crimping terminal 1 is positioned. In addition, the protruding portion 124*a* inserted into the terminal feed hole 31*a* regulates a change in orientation of the crimping terminal 1. For example, the protruding portion 124*a* regulates the movement of the crimping terminal 1 such as rotation around an axis extending in the first direction L, twist, and swing in the second direction W. Because one end of the crimping terminal 1 is supported by the supporting stopper 119, and the other end is supported by the pin 124, a change in orientation of the crimping terminal 1 is preferably suppressed.

An operator that operates the terminal crimping apparatus 100 can visually check whether the protruding portion 124*a* is correctly inserted into the terminal feed hole 31*a*, using the through-hole 121*h* provided in the terminal cutting member 121. As illustrated in FIG. 21, the through-hole 121*h* is formed at a position at which the protruding portion 124*a* can be visually observed. For example, the operator visually checks whether the protruding portion 124*a* appropriately enters the terminal feed hole 31*a*, when the forefront crimping terminal 1 of the terminal chain member 30 is supplied to the crimping position.

Figure 23:
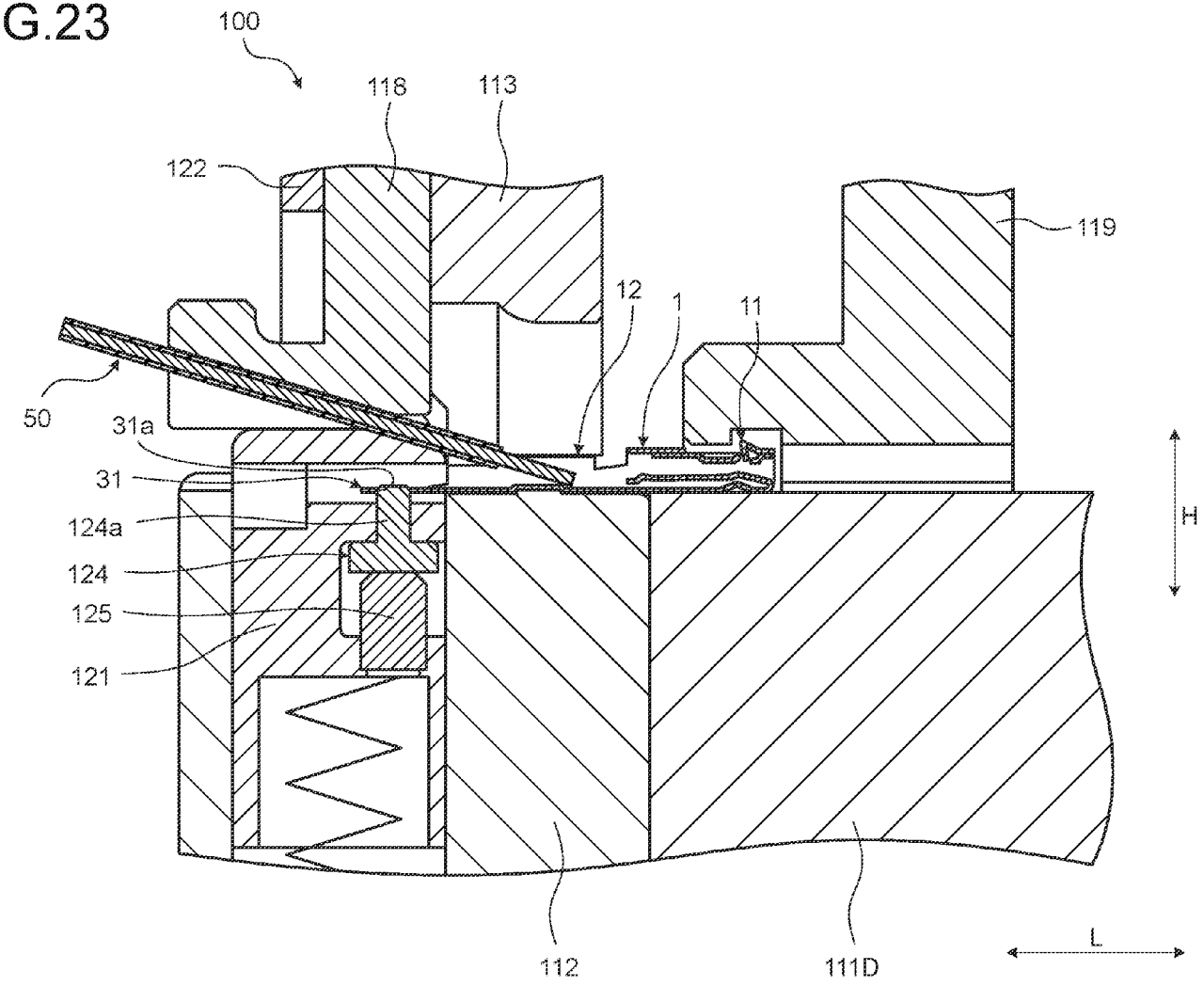
FIG. 23 is a cross-sectional view illustrating a state in which the second mold has started contact with a wire connection portion.

FIG. 23 illustrates a state in which the second mold 113 has started contact with the wire connection portion 12. More specifically, FIG. 23 illustrates a state in which the crimping of the wire connection portion 12 has been started by the second mold 113. At this time, the protruding portion 124*a* of the pin 124 remains inserted into the terminal feed hole 31*a*. Thus, inclination of the wire connection portion 12 at the start of the crimping is suppressed.

Figure 24:
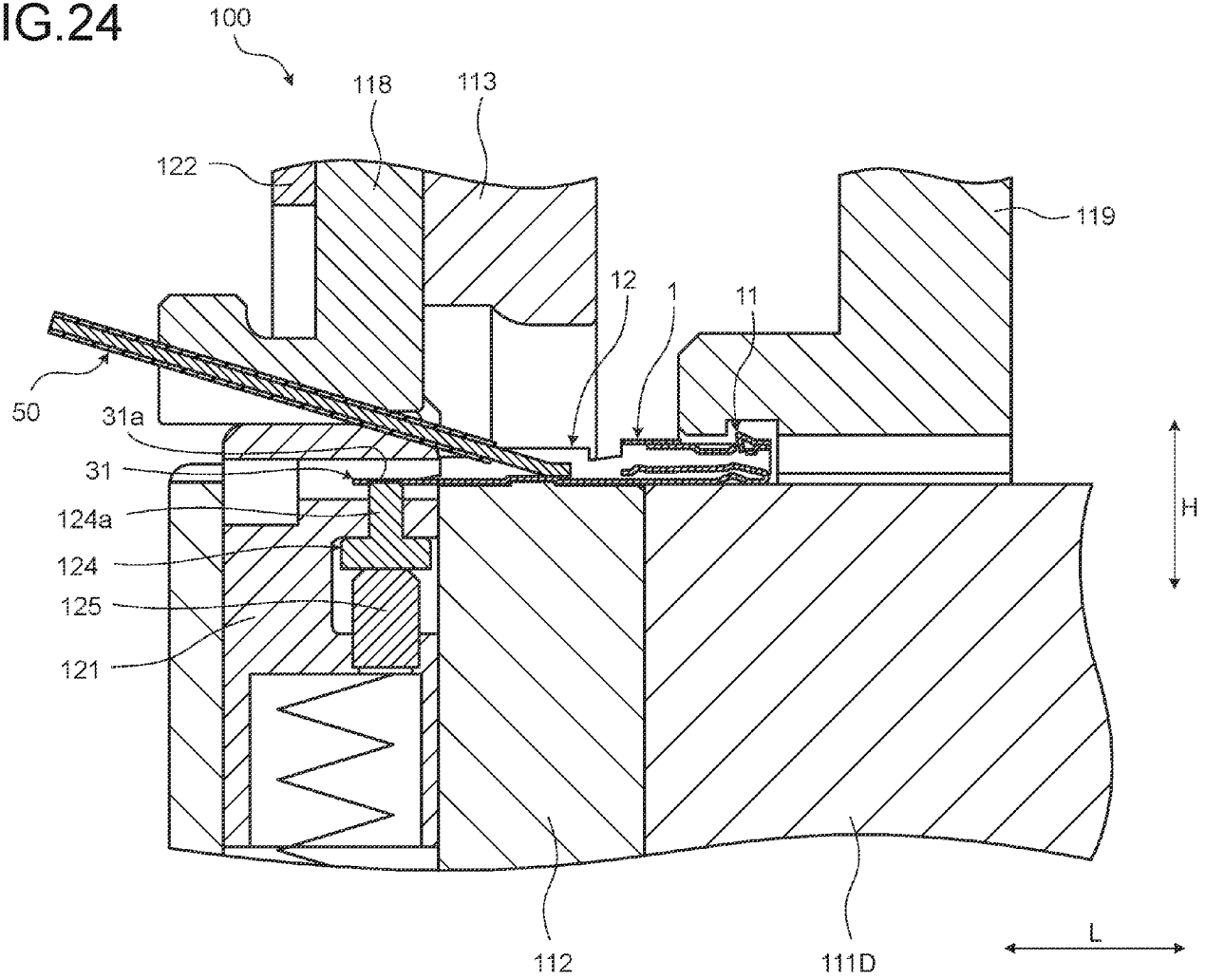
FIG. 24 is cross-sectional view illustrating a state in which a protruding portion has got out of a terminal feed hole.

FIG. 24 illustrates a state in which the protruding portion 124*a* has got out of the terminal feed hole 31*a*. From the state illustrated in FIG. 23, the terminal cutting member 121 lowers in conjunction with the lowering of the second mold 113. By the terminal cutting member 121 lowering, the protruding portion 124*a* of the pin 124 gets out of the terminal feed hole 31*a*. The second mold 113 continues to wind the wire connection portion 12 around the wire 50.

Figure 25:
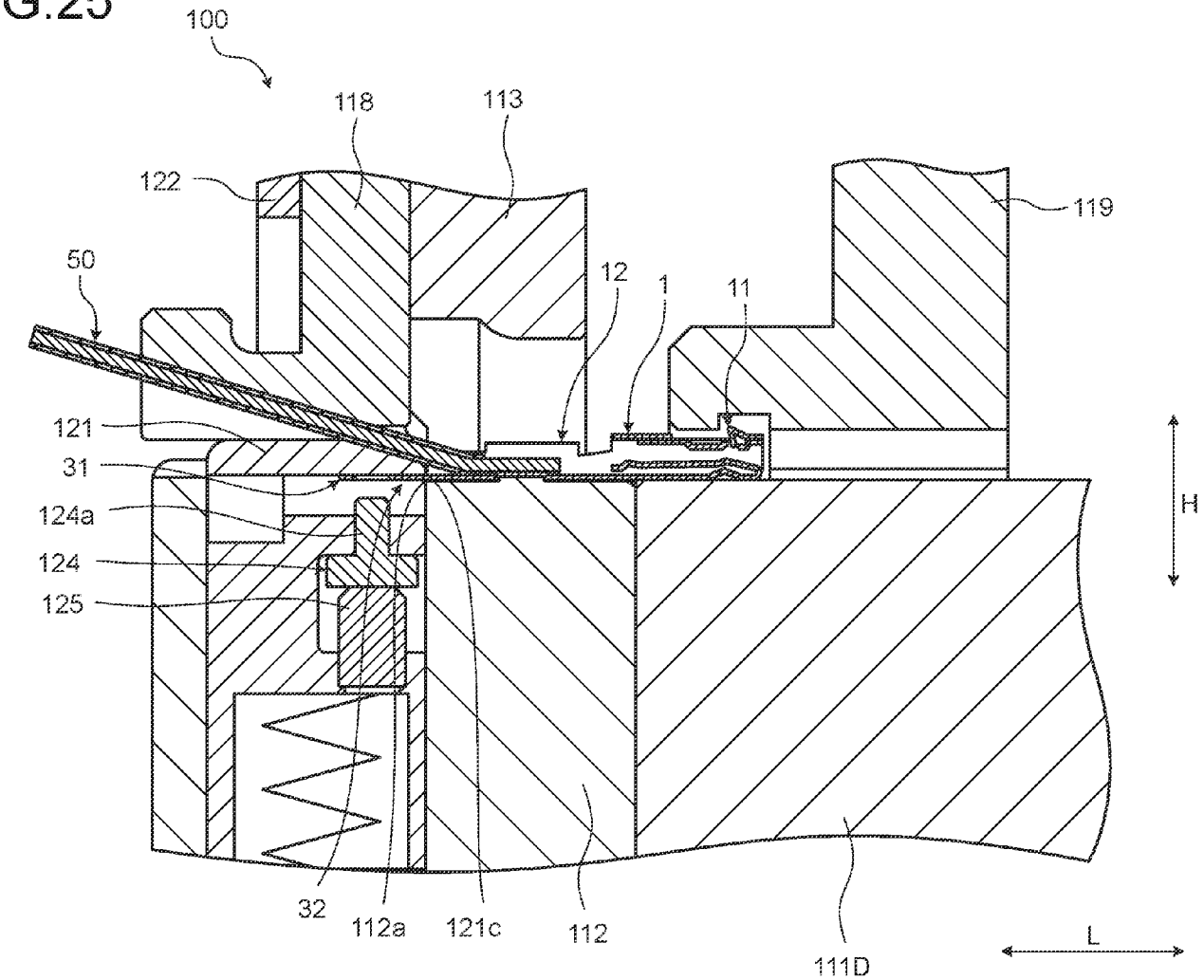
FIG. 25 is a cross-sectional view illustrating a state in which a terminal cutting process is started.

FIG. 25 illustrates a state in which the terminal cutting process is started. If the terminal cutting member 121 further lowers from the state illustrated in FIG. 24, the opening edge 121*c* comes into contact with the link portion 32. FIG. 25 illustrates a state in which the opening edge 121*c* is in contact with the link portion 32.

Figure 26:
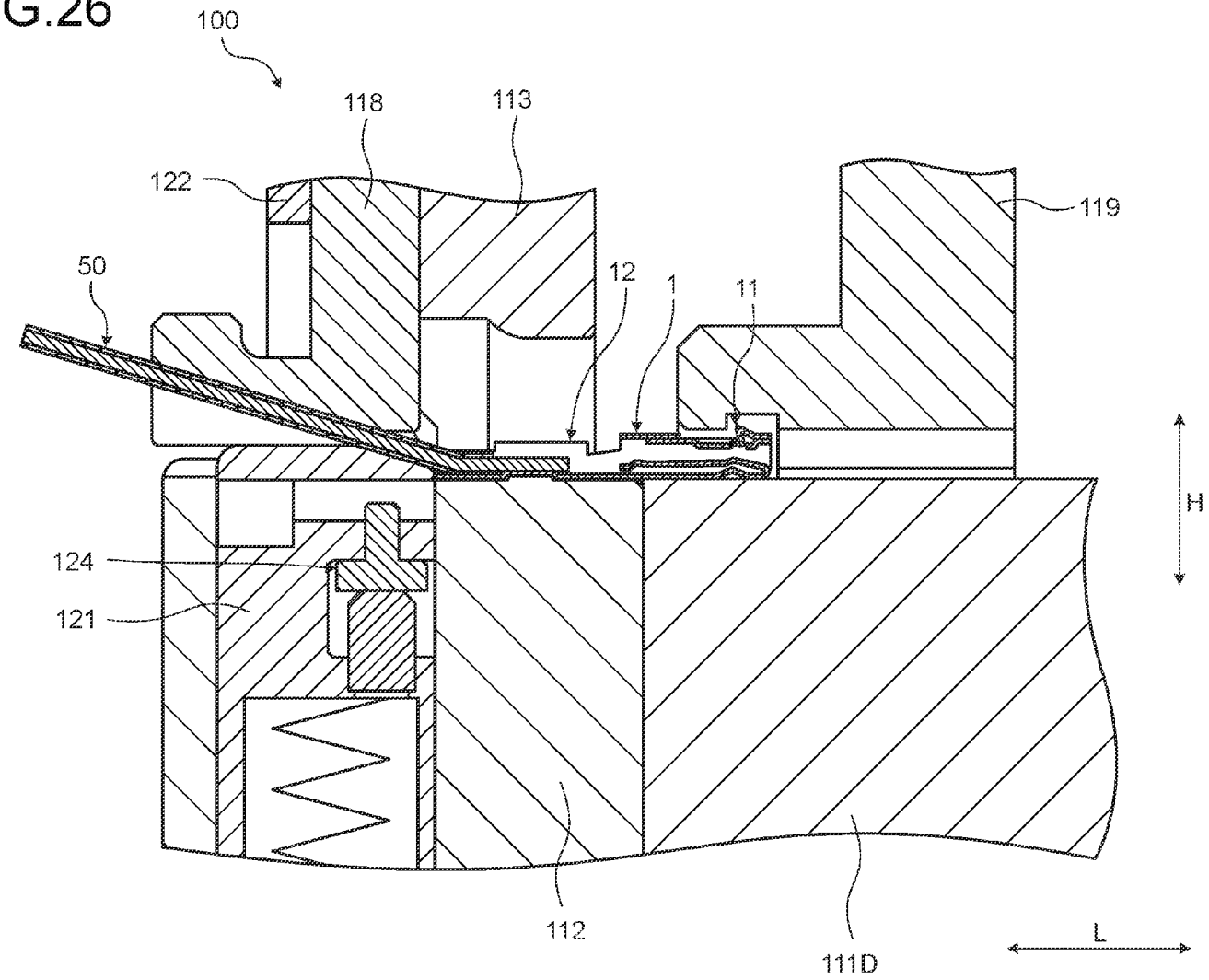
FIG. 26 is a cross-sectional view illustrating a state in which the terminal cutting process has been completed.

FIG. 26 illustrates a state in which the terminal cutting process has been completed. If the terminal cutting member 121 further lowers from the state illustrated in FIG. 25, the opening edge 121*c* cuts the link portion 32 in cooperation with the top surface edge 112*a*. FIG. 26 illustrates a state in which the cut of the link portion 32 has been completed.

In this manner, the terminal cutting member 121 of the first modified example includes the pin 124 inserted into the terminal feed hole 31*a* of the joint piece 31 to position the crimping terminal 1. The pin 124 remains in the state of being inserted into the terminal feed hole 31*a* at least until the second mold 113 starts the crimping of the wire connection portion 12. This regulates a change in orientation the wire connection portion 12 at the start of the crimping, and stabilizes the orientation of the wire connection portion 12.

When the link portion 32 is cut by the lowering of the terminal cutting member 121, the protruding portion 124*a* of the pin 124 gets out of the terminal feed hole 31*a*. Thus, discharge of the cut-off link portion 32 and the joint piece 31 is not interrupted.

When the crimping of the wire connection portion 12 is completed, the pin 124 also rises in accordance with the rising of the terminal cutting member 121. The protruding portion 124*a* of the pin 124 picks up the terminal feed hole 31*a* of the joint piece 31 fed by the terminal supply device 101, to enter the terminal feed hole 31*a*. In this manner, the terminal cutting member 121 of this modified example can position the crimping terminal 1 by the pin 124, using the up-and-down movement for cutting the link portion 32, and furthermore, hold the orientation of the crimping terminal 1 during a period until the crimping is started.

As described above, the terminal cutting member 121 according to the first modified example includes the protruding portion 124*a* inserted into the terminal feed hole 31*a* of the joint piece 31 to position the crimping terminal 1. By positioning the crimping terminal 1 using the protruding portion 124*a*, the terminal cutting member 121 can suppress a variation in a cut position in the terminal cutting process. In addition, the protruding portion 124*a* can stabilize the crimping operation in the crimping process by holding the orientation of the crimping terminal 1.

In addition, an insertion target of the protruding portion 124*a* is not limited to the terminal feed hole 31*a*. The protruding portion 124*a* may be inserted into another hole provided in the joint piece 31. For example, the protruding portion 124*a* may be inserted into a hole portion 31*c* illustrated in FIG. 7. The hole portion 31*c* is provided between one terminal feed hole 31*a* and a subsequent terminal feed hole 31*a* following this. The hole portion 31*c* is provided at a position on an extended line of the link portion 32. The shape of the hole portion 31*c* is a circular shape. The shape of the protruding portion 124*a* to be inserted into the hole portion 31*c* may be a rectangular column shape. In addition, a protruding portion provided in the terminal cutting member 121 is not limited to the protruding portion 124*a* of the pin 124 that has been exemplified. For example, the protruding portion 124*a* may be formed integrally with the terminal cutting member 121. The protruding portion 124*a* may include a male screw portion, and may be directly screwed into a female screw portion provided in the terminal cutting member 121.

The protruding portion 124*a* may be formed so as to be smoothly inserted into the terminal feed hole 31*a* or the hole portion 31*c*. For example, a distal end portion of the protruding portion 124*a* may have a tapered shape. In addition, a distal end surface of the protruding portion 124*a* may be inclined. As an example, the distal end surface of the protruding portion 124*a* may be an inclined surface inclining downward toward the front side in a traveling direction of the joint piece 31.

Second Modified Example of Embodiment

Figure 27:
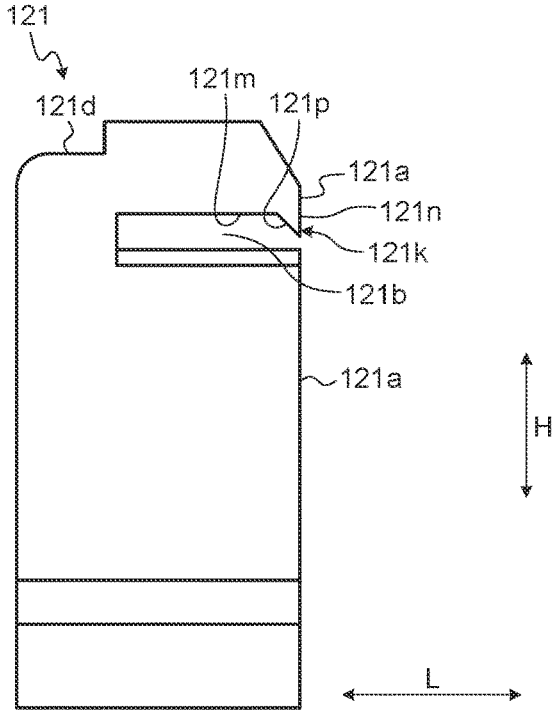
FIG. 27 is a side view of a terminal cutting member according to a second modified example of an embodiment.
Figure 28:
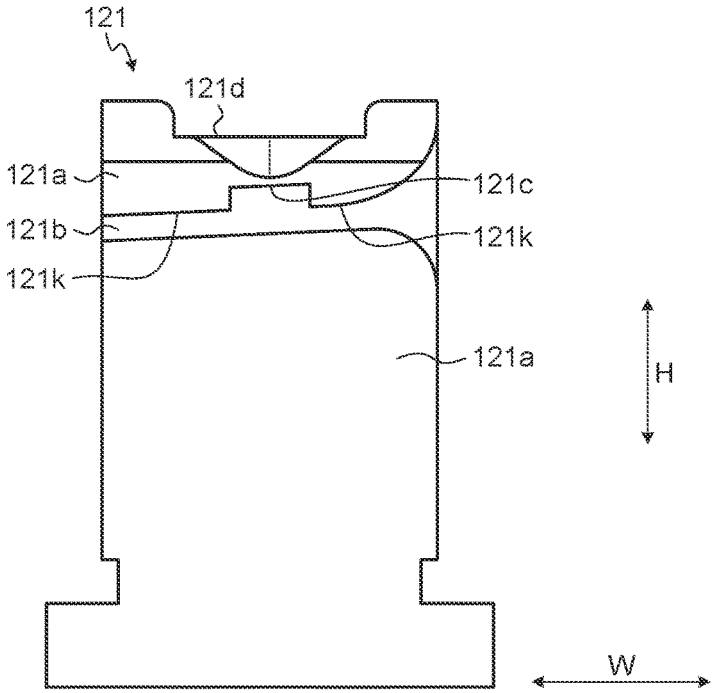
FIG. 28 is a rear view of the terminal cutting member according to the second modified example of an embodiment.
Figure 29:
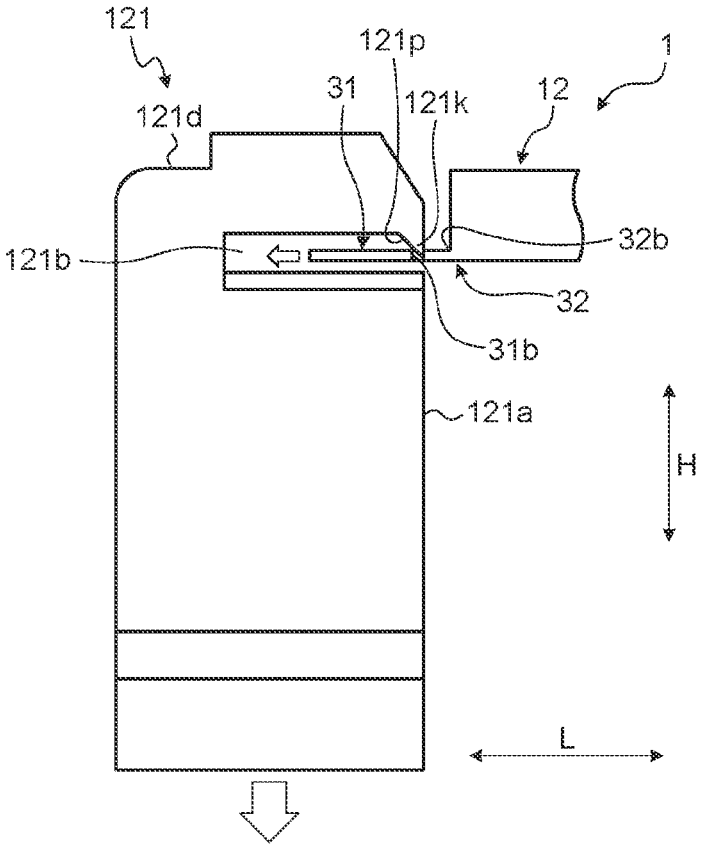
FIG. 29 is a side view illustrating an operation of a guide portion according to the second modified example of an embodiment.

A second modified example of the embodiment will be described. FIG. 27 is a side view of a terminal cutting member according to the second modified example of the embodiment, FIG. 28 is a rear view of the terminal cutting member according to the second modified example of the embodiment, and FIG. 29 is a side view illustrating an operation of a guide portion of the second modified example of the embodiment. The terminal cutting member 121 of the second modified example differs from that in the above-described embodiment in that the terminal cutting member 121 includes a guide portion 121*k*.

As illustrated in FIGS. 27 and 28, the guide portion 121*k* is provided in an opening portion on the first mold 112 side of the slit 121*b*. The slit 121*b* is a groove portion provided on the sliding contact surface 121*a* being a surface on the first mold 112 side of the terminal cutting member 121. The guide portion 121*k* is provided on a wall surface 121*m* on the upper side of the slit 121*b*. The guide portion 121*k* protrudes downward from the wall surface 121*m* on the upper side. In addition, the guide portion 121*k* extends in the second direction W. As illustrated in FIG. 28, the guide portions 121*k* are provided on the both sides in the second direction W across the opening edge 121*c*. The width of the opening edge 121*c* is broader than at least the width of the link portion 32. The guide portions 121*k* are provided at positions at which interference with the link portion 32 does not occur in the terminal cutting process.

As illustrated in FIG. 27, the guide portion 121*k* is formed into a tapered shape having a width in the first direction L that is narrowing downward from the wall surface 121*m* on the upper side. More specifically, a lateral surface 121*n* of the guide portion 121*k* is a surface connected to the sliding contact surface 121*a*. On the other hand, a guide surface 121*p* the guide portion 121*k* is an inclined surface. The guide surface 121*p* is a surface facing an internal space of the slit 121*b*. The guide surface 121*p* is inclined to be oriented obliquely downward. In other words, the guide surface 121*p* is inclined upward toward the rear side of the slit 121*b*.

As will be described with reference to FIG. 29, the guide portion 121*k* can adjust the position in the first direction L of the crimping terminal 1. FIG. 29 illustrates the crimping terminal 1 and the joint piece 31 in a state in which a position shift has occurred. Force that warps the joint piece 31 is applied to the joint piece 31 by the weight of the crimping terminal 1, load applied to the crimping terminal 1 in the crimping process, and the like. This force pulls the joint piece 31 toward the crimping terminal 1 side, and as illustrated in FIG. 29, a position in the first direction L sometimes shifts from a desired position.

The guide surface 121*p* of the guide portion 121*k* comes into contact with a side surface 31*b* on the crimping terminal 1 side of the joint piece 31, to guide the joint piece 31. When the terminal cutting member 121 lowers, the guide surface 121*p* presses the side surface 31*b* toward the rear side of the slit 121*b*. The guide surface 121*p* moves the joint piece 31 and the crimping terminal 1 toward the rear side of the slit 121*b* so that positions in the first direction L of the joint piece 31 and the crimping terminal 1 become predefined positions.

In this manner, the terminal cutting member 121 of this modified example includes the guide portions 121*k* that guide the joint piece 31 to adjust the position of the crimping terminal 1. The terminal cutting member 121 can suppress a position shift of the crimping terminal 1 in the crimping, using the guide portions 121*k*. As a result, a crimping failure such as twist deformation of the crimping terminal 1 and fray of the core wire 51 can be suppressed. In addition, by adjusting the position of the crimping terminal 1, the guide portions 121*k* can suppress a position shift of a cut location in the terminal cutting process. The guide portions 121*k* adjust positions in the first direction L of the joint piece 31 and the crimping terminal 1 so that the boundary 32*b* of the link portion 32 is cut. This suppresses the generation of the cutoff 32*a*.

In addition, the arrangement and the shape of the guide portions 121*k* are not limited to those exemplified. For example, the shape of the guide portions 121*k* needs not be a tapered shape. The number of the guide portions 121*k* provided in the terminal cutting member 121 may be one, or three or more.

Third Modified Example of Embodiment

Figure 31:
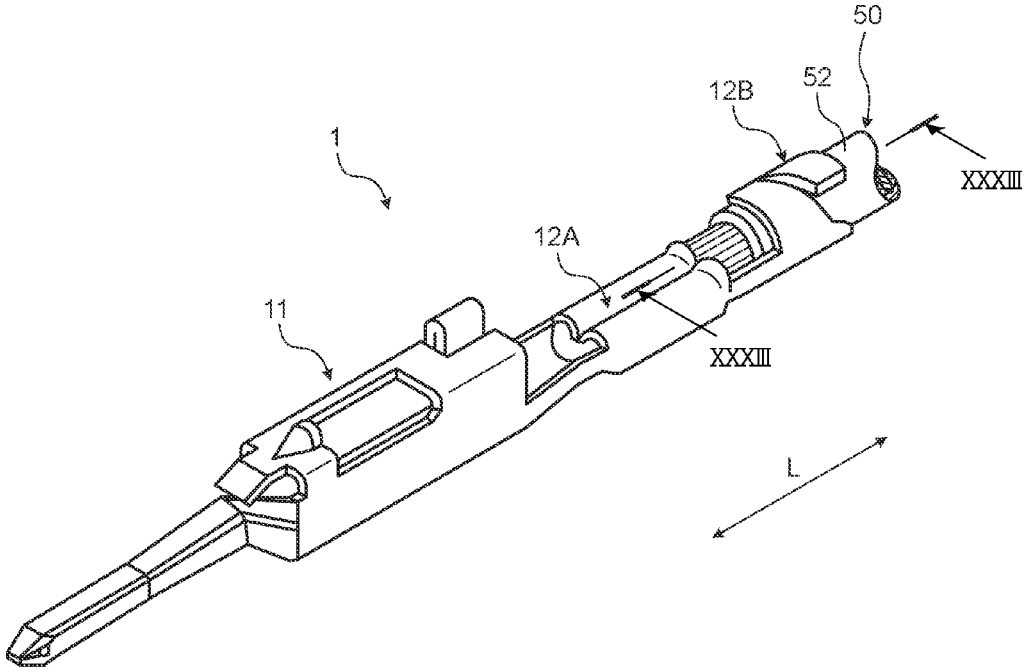
FIG. 31 is a perspective view of a crimping terminal according to a third modified example of an embodiment.
Figure 32:
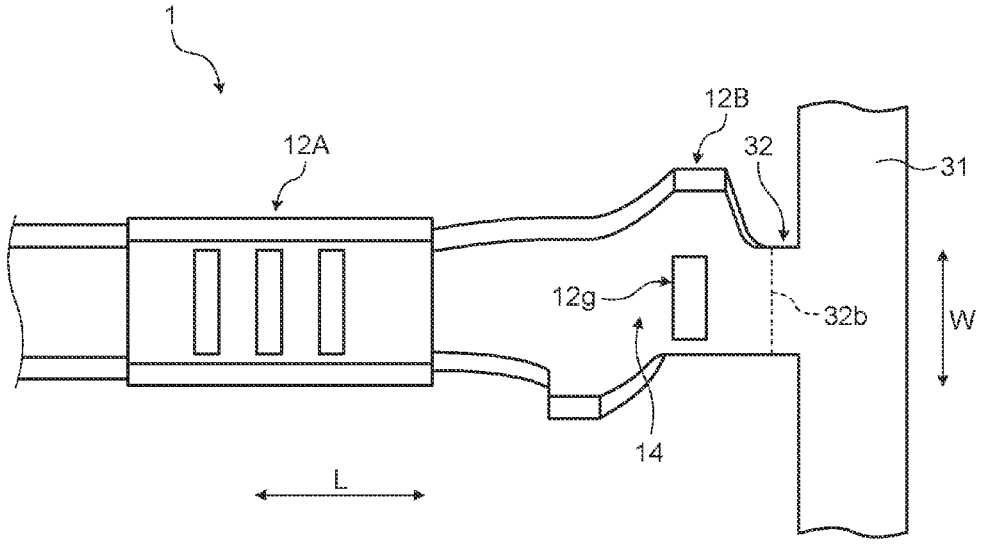
FIG. 32 is a plan view of the crimping terminal according to the third modified example of an embodiment.
Figure 33:
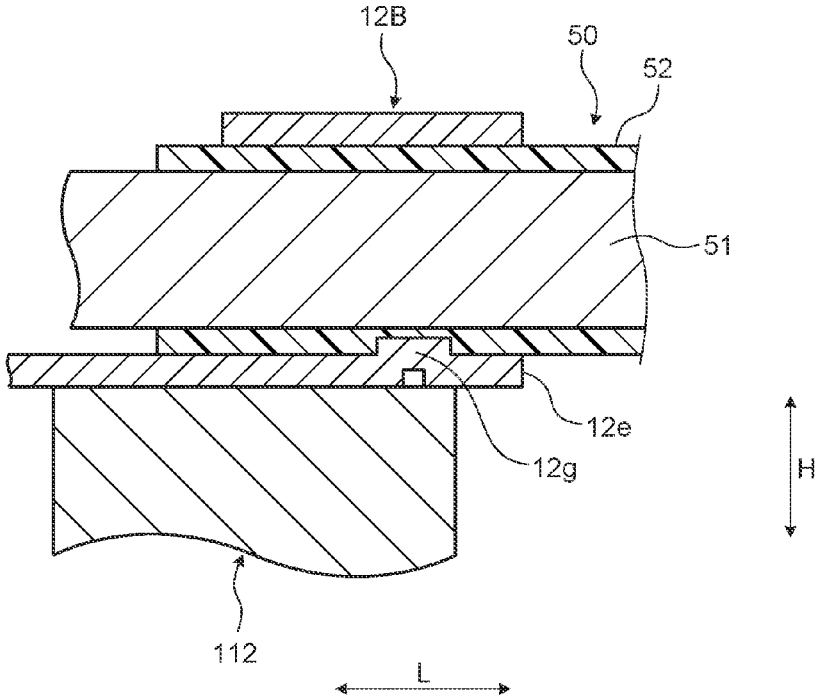
FIG. 33 is a cross-sectional view of the crimping terminal according to the third modified example of an embodiment.
Figure 34:
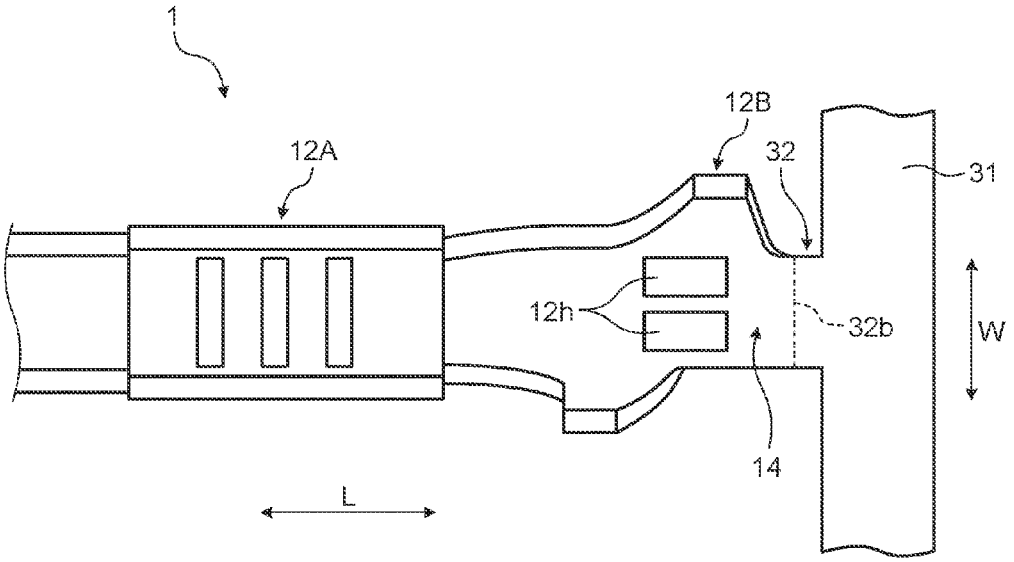
FIG. 34 is a plan view of another crimping terminal according to the third modified example of an embodiment.

A third modified example of the embodiment will be described. FIG. 31 is a perspective view of a crimping terminal according to the third modified example of the embodiment, FIG. 32 is a plan view of the crimping terminal according to the third modified example of the embodiment, FIG. 33 is a cross-sectional view of the crimping terminal according to the third modified example of the embodiment, and FIG. 34 is a plan view of another crimping terminal according to the third modified example of the embodiment. FIG. 33 illustrates a XXXIII-XXXIII cross section in FIG. 31. The crimping terminal 1 of the third modified example of the embodiment differs from that in the above-described embodiment in that a protrusion 12*g* is provided in the wire connection portion 12.

As illustrated in FIG. 31, the crimping terminal 1 according to the third modified example is a terminal of a type in which the core wire crimping portion 12A and the covering crimping portion 12B are individually crimped. Nevertheless, the crimping terminal 1 may be a terminal in which the core wire crimping portion 12A and the covering crimping portion 12B is connected to form one piece portion, similarly to the above-described embodiment.

Figure 30:
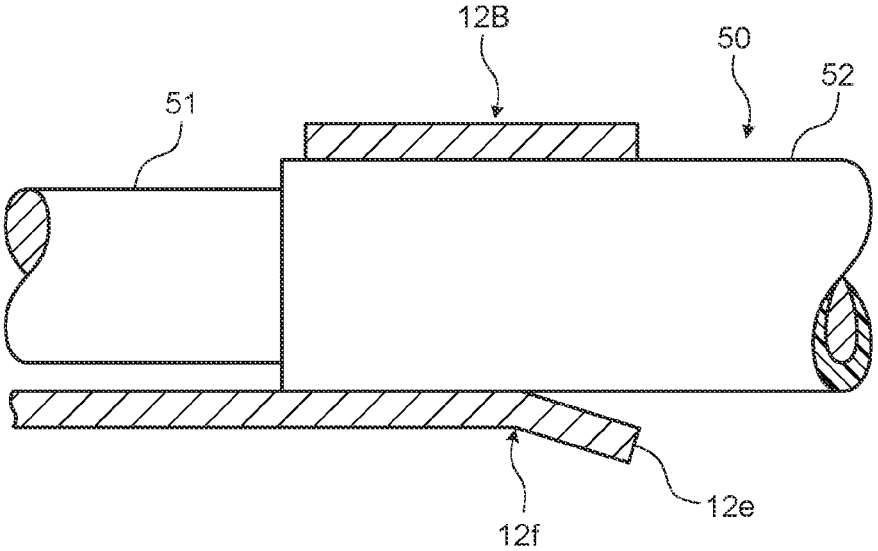
FIG. 30 is a diagram illustrating a modification of a wire connection portion.

As in the above-described embodiment, when the link portion 32 is cut so as not to generate the cutoff 32*a* in the terminal cutting process, bending of the wire connection portion 12 sometimes occurs in the crimping process. As described with reference to FIG. 16, the main body 113M and the proximal end portions 113$C_1$ and 113$D_1$ of the second mold 113 of the above-described embodiment jut more than the top surface edge 112*a* toward the terminal cutting member 121 side. When the wire connection portion 12 extended in the crimping process protrudes more than the recessed surface 112$B_1$ toward the terminal cutting member 121 side, the wire connection portion 12 sometimes deforms due to the load applied from the second mold 113. For example, as illustrated in FIG. 30, a bent portion 12*f* is generated on the bottom surface of the covering crimping portion 12B, and a cut portion 12*e* side may be separated from the covering 52. If a lap amount of the covering crimping portion 12B and the covering 52 is reduced in this manner, fixing force of the wire connection portion 12 with respect to the wire 50 declines. In addition, when the crimping terminal 1 is inserted into the terminal accommodation portion, the uplifted cut portion 12*e* side comes into contact with the terminal accommodation portion, and the resin of the terminal accommodation portion may be scraped.

In view of this, the crimping terminal 1 of the third modified example includes the protrusion 12*g* formed in the covering crimping portion 12B as illustrated in FIG. 32. The protrusion 12*g* is provided on the bottom portion 14 of the covering crimping portion 12B. As illustrated in FIG. 33, the protrusion 12*g* is protruding toward a side on which the wire 50 is placed. For example, the protrusion 12*g* is formed through embossing processing. For example, a planar shape of the protrusion 12*g* is an oblong. The protrusion 12*g* of this modified example is formed into a rectangle having a longitudinal direction corresponding to the second direction W, and a lateral direction corresponding to the first direction L. For example, the protrusion 12*g* is formed to extend in parallel with the boundary 32*b* of the link portion 32. For example, a position in the first direction L of the protrusion 12*g* is a position near the boundary 32*b*.

If the protrusion 12*g* is formed, rigidity of the bottom portion 14 increases as compared with a case in which the protrusion 12*g* is not formed. The rigidity of the covering crimping portion 12B including the protrusion 12*g* increases due to the shape itself and work hardening. The increase in rigidity suppresses the deformation of the covering crimping portion 12B in the crimping process. The protrusion 12*g* can distribute pressure applied in the crimping to suppress the deformation of the covering crimping portion 12B. If the deformation of the covering crimping portion 12B is suppressed, electrical performance, fixing performance, and airtightness are enhanced. In addition, the protrusion 12*g* having the longitudinal direction corresponding to the second direction W can effectively suppress the extension itself of the crimping terminal 1 in the crimping process.

As illustrated in FIG. 33, the protrusion 12*g* may be provided in a range supported by the first mold 112. In FIG. 33, the protrusion 12*g* is provided at a position facing the recessed surface 112$B_1$ of the first mold 112. For example, the protrusion 12*g* is provided at an end portion on the cut portion 12*e* side in a range facing the recessed surface 112$B_1$.

Protrusions 12*h* illustrated in FIG. 34 may be provided in place of the protrusion 12*g*. Similarly to the protrusion 12*g*, the protrusions 12*h* are provided on the bottom portion 14 of the covering crimping portion 12B. Similarly to the protrusion 12*g*, the protrusions 12*h* are protruding toward a side on which the wire 50 is placed. The protrusions 12*h* are formed into a rectangle having a longitudinal direction corresponding to the first direction L, and a lateral direction corresponding to the second direction W. The two protrusions 12*h* are disposed in parallel in the covering crimping portion 12B. For example, the protrusions 12*h* are provided so that one ends are positioned near the boundary 32*b*. Similarly to the protrusion 12*g*, the protrusions 12*h* can suppress bending of the covering crimping portion 12B in the crimping process.

The matters disclosed in the above-described embodiment and modified examples can be executed while being appropriately combined.

A terminal crimping apparatus according to the present embodiments includes a terminal supply device configured to supply a terminal chain member including a plurality of crimping terminals arranged in parallel, a joint piece extending in an arrangement direction of the plurality of crimping terminals, and link portions linking one ends of the crimping terminals and the joint piece, a first mold including a supporting surface supporting the crimping terminals supplied by the terminal supply device, and a first edge portion provided at one end of the supporting surface, a second mold disposed to face the supporting surface, and configured to crimp the crimping terminal onto a wire by sandwiching the crimping terminal and the wire between the second mold and the supporting surface while relatively moving with respect to the supporting surface, and a terminal cutting member disposed adjacently to the first mold, and including a second edge portion corresponding to the first edge portion.

The terminal cutting member cuts a boundary with the crimping terminal in the link portion using the second edge portion, in cooperation with the first edge portion, while relatively moving with respect to the first mold in a same direction as a movement of the second mold. The second mold includes a main body, and a pair of wall portions protruding from the main body toward the first mold side, and facing each other in the arrangement direction of the crimping terminals, and coming into contact with the crimping terminal to bend the crimping terminal. The pair of wall portions include proximal end portions being portions provided on the main body side, and hem portions being portions provided closer to a distal end side than the proximal end portions. The main body and the proximal end portions protrude more than the first edge portion toward the terminal cutting member side, and the hem portions are positioned closer to the first mold side than the first edge portion. The terminal crimping apparatus according to the present embodiments can shorten a cutoff by the terminal cutting member cutting the boundary with the crimping terminal in the link portion. In addition, because the hem portions of the second mold are positioned closer to the first mold side than the first edge portion, interference between the second mold and the terminal cutting member is suppressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A terminal crimping apparatus comprising:

a terminal supply device configured to supply a terminal chain member including a plurality of crimping terminals arranged in parallel extending in a length direction, a joint piece extending in an arrangement direction of the plurality of crimping terminals arranged perpendicular to the length direction, and link portions linking one ends of the crimping terminals and the joint piece;

a first mold including a supporting surface supporting the crimping terminals supplied by the terminal supply device and a first edge portion provided at one end of the supporting surface;

a second mold disposed to face the supporting surface and configured to crimp the crimping terminal onto a wire by sandwiching the crimping terminal and the wire between the second mold and the supporting surface while relatively moving along a height direction with respect to the supporting surface of the first mold; and a terminal cutting member disposed adjacently to the first mold and including a second edge portion corresponding to the first edge portion, wherein the terminal cutting member cuts a boundary with the crimping terminal in the link portion using the second edge portion in cooperation with the first edge portion while relatively moving along the height direction with respect to the first mold, the second mold includes a main body and a pair of wall portions protruding from the main body toward the first mold and facing each other in the arrangement direction of the crimping terminals and configured to come into contact with the crimping terminal to bend the crimping terminal when the second mold relatively moves along the height direction with respect to the supporting surface of the first mold, the pair of wall portions include proximal end portions provided on a main body side of the main body facing the terminal cutting member and hem portions provided on a distal end side of the main body provided further from the terminal cutting member than the proximal end portions, and the main body and the proximal end portions protrude further toward the terminal cutting member compared to the first edge portion of the first mold, and the hem portions are positioned closer to the first mold than the first edge portion of the first mold.

2. The terminal crimping apparatus according to claim 1, wherein the hem portions are provided in a range set according to a movement distance by which the second mold relatively moves along the height direction with respect to the terminal cutting member when the crimping terminal is crimped.

3. The terminal crimping apparatus according to claim 2, wherein the terminal cutting member includes a protruding portion to be inserted into a hole portion included in the joint piece to position the crimping terminal.

4. The terminal crimping apparatus according to claim 3, wherein a surface on the terminal cutting member facing the first mold includes a groove portion being a pathway of the joint piece, and a guide portion configured to guide the joint piece to adjust a position of the crimping terminal is provided in an opening portion on a side of the groove portion facing the first mold.

5. The terminal crimping apparatus according to claims 2, wherein a surface on the terminal cutting member facing the first mold includes a groove portion being a pathway of the joint piece, and a guide portion configured to guide the joint piece to adjust a position of the crimping terminal is provided in an opening portion on a side of the groove portion facing the first mold.

6. The terminal crimping apparatus according to claim 1, wherein the terminal cutting member includes a protruding portion to be inserted into a hole portion included in the joint piece to position the crimping terminal.

7. The terminal crimping apparatus according to claim 6, wherein a surface on the terminal cutting member facing the first mold includes a groove portion being a pathway of the joint piece, and a guide portion configured to guide the joint piece to adjust a position of the crimping terminal is provided in an opening portion on a side of the groove portion facing the first mold.

8. The terminal crimping apparatus according to claim 1, wherein a surface on the terminal cutting member facing the first mold includes a groove portion being a pathway of the joint piece, and a guide portion configured to guide the joint piece to adjust a position of the crimping terminal is provided in an opening portion on a side of the groove portion facing the first mold.

* * * * *